US009256148B2

(12) United States Patent
Fujikawa et al.

(10) Patent No.: US 9,256,148 B2
(45) Date of Patent: Feb. 9, 2016

(54) TONER

(75) Inventors: Hiroyuki Fujikawa, Yokohama (JP); Kunihiko Nakamura, Gotemba (JP); Nozomu Komatsu, Toride (JP); Kosuke Fukudome, Tokyo (JP); Yoshiaki Shiotari, Mishima (JP); Takayuki Itakura, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 13/988,736

(22) PCT Filed: Nov. 24, 2011

(86) PCT No.: PCT/JP2011/077739
§ 371 (c)(1),
(2), (4) Date: May 21, 2013

(87) PCT Pub. No.: WO2012/074034
PCT Pub. Date: Jun. 7, 2012

(65) Prior Publication Data

US 2013/0244164 A1 Sep. 19, 2013

(30) Foreign Application Priority Data

Nov. 29, 2010 (JP) ..... 2010-265602

(51) Int. Cl.

| | |
|---|---|
| ***G03G 5/14*** | (2006.01) |
| ***G03G 9/087*** | (2006.01) |
| ***G03G 9/08*** | (2006.01) |
| ***G03G 9/097*** | (2006.01) |

(52) U.S. Cl.
CPC ..... *G03G 9/087* (2013.01); *G03G 9/0819* (2013.01); *G03G 9/0821* (2013.01); *G03G 9/08704* (2013.01); *G03G 9/08782* (2013.01); *G03G 9/08797* (2013.01); *G03G 9/09708* (2013.01)

(58) Field of Classification Search
USPC ..... 430/110.3
See application file for complete search history.

(56) References Cited

U.S. PATENT DOCUMENTS

| | | | |
|---|---|---|---|
| 5,618,647 | A | 4/1997 | Kukimoto et al. |
| 5,968,701 | A | 10/1999 | Onuma et al. |
| 6,020,102 | A | 2/2000 | Fujimoto et al. |
| 6,120,961 | A | 9/2000 | Tanikawa et al. |
| 6,156,471 | A | 12/2000 | Kobori et al. |

(Continued)

FOREIGN PATENT DOCUMENTS

| | | | |
|---|---|---|---|
| CN | 1137123 | A | 12/1996 |
| CN | 101082785 | A | 12/2007 |

(Continued)

OTHER PUBLICATIONS

Translation of JP 10-254173 published Sep. 1998.*

(Continued)

*Primary Examiner* — Peter Vajda
(74) *Attorney, Agent, or Firm* — Fitzpatrick, Cella, Harper and Scinto

(57) ABSTRACT

A toner having toner particles, each of which contains a binder resin, a wax and inorganic fine particles, wherein the inorganic fine particles are fixed at the surface of the toner particles as a result of a surface treatment by hot air, and the degree of uneven distribution of wax in the toner is controlled in a depth direction of the toner, from the toner surface towards a toner central portion.

5 Claims, 1 Drawing Sheet

(56) References Cited

U.S. PATENT DOCUMENTS

| | | | |
|---|---|---|---|
| 6,174,641 | B1 | 1/2001 | Nakamura et al. |
| 6,203,959 | B1 | 3/2001 | Tanikawa et al. |
| 6,214,511 | B1 | 4/2001 | Akazawa et al. |
| 6,235,441 | B1 | 5/2001 | Tanikawa et al. |
| 6,326,114 | B1 | 12/2001 | Itakura et al. |
| 6,528,222 | B2 | 3/2003 | Kohtaki et al. |
| 6,586,147 | B2 | 7/2003 | Iida et al. |
| 6,653,036 | B1 | 11/2003 | Tanikawa et al. |
| 6,664,016 | B2 | 12/2003 | Kanbayashi et al. |
| 6,670,087 | B2 | 12/2003 | Fujikawa et al. |
| 6,751,424 | B2 | 6/2004 | Komatsu et al. |
| 6,808,852 | B2 | 10/2004 | Hotta et al. |
| 6,905,808 | B2 | 6/2005 | Itakura et al. |
| 6,929,894 | B2 | 8/2005 | Sugahara et al. |
| 7,022,449 | B2 | 4/2006 | Sugahara et al. |
| 7,112,395 | B2 | 9/2006 | Ida et al. |
| 7,115,349 | B2 | 10/2006 | Iida et al. |
| 7,138,213 | B2 | 11/2006 | Itakura et al. |
| 7,144,668 | B2 | 12/2006 | Baba et al. |
| 7,147,980 | B2 | 12/2006 | Itakura et al. |
| 7,147,981 | B2 | 12/2006 | Fujikawa et al. |
| 7,229,727 | B2 | 6/2007 | Itakura et al. |
| 7,279,262 | B2 | 10/2007 | Fujikawa et al. |
| 7,288,348 | B2 | 10/2007 | Hayami et al. |
| 7,297,455 | B2 | 11/2007 | Fujikawa et al. |
| 7,300,733 | B2 | 11/2007 | Sugahara et al. |
| 7,320,850 | B2 | 1/2008 | Itakura et al. |
| 7,361,441 | B2 | 4/2008 | Itakura et al. |
| 7,396,626 | B2 | 7/2008 | Fujikawa et al. |
| 7,396,629 | B2 | 7/2008 | Baba et al. |
| 7,442,478 | B2 | 10/2008 | Itakura et al. |
| 7,452,647 | B2 | 11/2008 | Hayami et al. |
| 7,611,813 | B2 | 11/2009 | Ida et al. |
| 7,695,880 | B2 | 4/2010 | Yoshimura et al. |
| 7,767,370 | B2 | 8/2010 | Ishigami et al. |
| 7,858,283 | B2 | 12/2010 | Ishigami et al. |
| 7,906,262 | B2 | 3/2011 | Ishigami et al. |
| 7,927,775 | B2 | 4/2011 | Komatsu et al. |
| 7,939,233 | B2 | 5/2011 | Inoue et al. |
| 8,007,978 | B2 | 8/2011 | Klier et al. |
| 8,114,562 | B2 | 2/2012 | Ishigami et al. |
| 8,137,886 | B2 | 3/2012 | Baba et al. |
| 8,142,972 | B2 | 3/2012 | Hotta et al. |
| 8,288,069 | B2 | 10/2012 | Fujikawa et al. |
| 8,323,726 | B2 | 12/2012 | Naka et al. |
| 8,349,531 | B2 | 1/2013 | Young et al. |
| 2007/0059626 | A1* | 3/2007 | Inoue et al. ..... 430/108.8 |
| 2009/0233212 | A1 | 9/2009 | Fujikawa et al. |
| 2009/0239171 | A1* | 9/2009 | Anno et al. ..... 430/109.4 |
| 2010/0136473 | A1* | 6/2010 | Ishigami et al. ..... 430/111.35 |
| 2010/0143837 | A1 | 6/2010 | Klier et al. |
| 2010/0183971 | A1 | 7/2010 | Fujikawa et al. |
| 2010/0248126 | A1 | 9/2010 | Ishigami et al. |
| 2011/0097661 | A1 | 4/2011 | Ishigami et al. |
| 2013/0171556 | A1 | 7/2013 | Fujikawa et al. |
| 2013/0244159 | A1 | 9/2013 | Ishigami et al. |
| 2013/0288173 | A1 | 10/2013 | Hashimoto et al. |
| 2013/0288174 | A1 | 10/2013 | Shiotari et al. |

FOREIGN PATENT DOCUMENTS

| | | | | |
|---|---|---|---|---|
| JP | 7-209910 | A | 8/1995 | |
| JP | 10-254173 | * | 9/1998 | ..... G03G 9/087 |
| JP | 10-254173 | A | 9/1998 | |
| JP | 2000-181118 | A | 6/2000 | |
| JP | 2000-330325 | A | 11/2000 | |
| JP | 2007-279239 | A | 10/2007 | |
| JP | 2010-217619 | A | 9/2010 | |
| RU | 2 397 525 | C2 | 8/2010 | |
| WO | 2007/103271 | A1 | 9/2007 | |
| WO | 2009/084620 | A1 | 7/2009 | |

OTHER PUBLICATIONS

Komatsu, et al., U.S. Appl. No. 13/902,365, filed May 24, 2013.
Ishigami, et al., U.S. Appl. No. 13/901,250, filed May 23, 2013.
Terauchi, et al., U.S. Appl. No. 13/922,205, filed Jun. 19, 2013.
PCT International Search Report and Written Opinion of the International Searching Authority, International Application No. PCT/JP2011/077739, Mailing Date Jan. 10, 2012.
Russian Office Action dated Apr. 15, 2014 in Russian Application No. 2013129843.
Taiwanese Office Action dated May 6, 2014 in Taiwanese Application No. 100143744.
Chinese Office Action dated Sep. 25, 2014 in Chinese Application No. 201180057210.9.

* cited by examiner

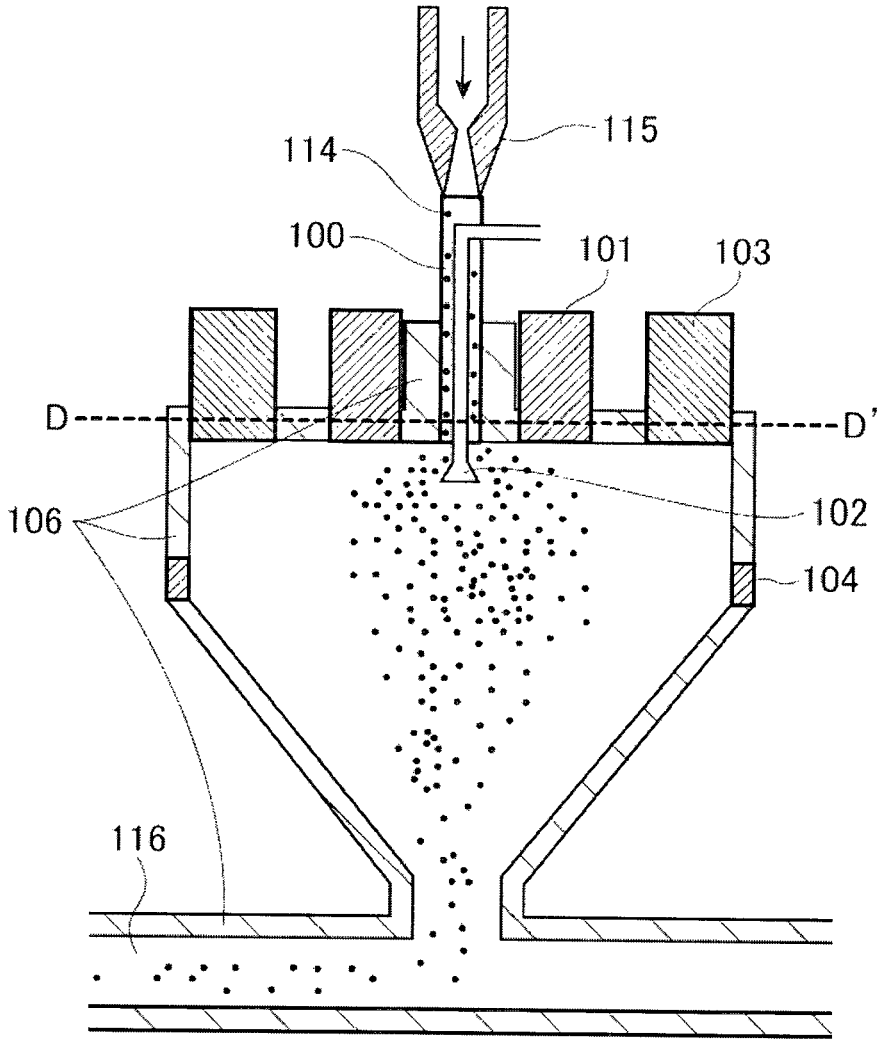
115
114
100
101
103
D
D'
106
102
104
116

TONER

TECHNICAL FIELD

The present invention relates to a toner that is used in electrophotographic systems, electrostatic recording systems, electrostatic printing systems and toner jet systems.

BACKGROUND ART

In recent years, various kinds of transfer material, such as glossy paper, cards, postcards and the like have come to be used, other than ordinary paper or film for overhead projectors (OHP), as transfer materials in full-color printers, full color copying machines and the like. Transfer methods that use intermediate transfer members have become therefore a mainstream feature.

In transfer methods that use intermediate transfer members, ordinarily, a visible toner image is transferred from an image bearing member to an intermediate transfer member, after which the toner image must be transferred again from the intermediate transfer member onto a transfer material. The number of transfers is thus greater than in conventional methods, and hence there is a demand for toners having higher transfer efficiency.

Ways of enhancing the transfer efficiency of toner include, for instance, spherization, through heating of toner that has been produced through pulverization (hereafter also referred to as pulverized toner). In a spherization process of pulverized toner through heating, wax leaches readily at the toner surface, and the surface abundance of wax may increase accordingly. This may result in decreased fluidity, worse fogging on account of lower charge quantity, and may give rise to melt adhesion of toner onto the image bearing member.

Patent document 1 discloses a toner that can be obtained by causing toner base particles to adhere to an external additive, and subjecting the toner base particles, in a dispersed state, to a surface modification treatment by hot air. This toner exhibits high-fluidity and high-charging performance characteristics, but may exhibit fogging at non-image portions, since it is difficult to completely remove toner in a process (cleaning process) in which there is removed residual toner that remains after transfer. In high-speed printing, such as print on demand (POD), moreover, the density of the obtained images fluctuates significantly. Charging stability of the toner has thus room for improvement.

Patent document 2 discloses a toner obtained by causing two types of external additive, having dissimilar average particle sizes, to adhere to toner base particles, and by performing a surface modification treatment by hot air with the toner base particles in a dispersed state.

Patent document 3 discloses a toner obtained by adding silica having an average primary particle size ranging from 35 to 300 nm and silica having an average primary particle size ranging from 4 to 30 nm, followed by spherization by a heat treatment.

The toners disclosed in Patent documents 2 and 3 have some degree of durability against toner stress in a developing device. However, in a case where such toner is used as a two-component developer in high-speed machines, such as in POD, there varies the triboelectric charge quantity with a magnetic carrier. This gives rise to changes in image density and fogging in non-image portions. Also, the fluidity of the developer in the developing device may become impaired. Low-temperature fixability and image gloss may likewise become impaired, and the adhesion force onto a fixing member may increase, causing the paper to wrap around the fixing unit as a result.

Thus, the toners disclosed in Patent documents 1 to 3 are not found to be satisfactory enough, being in need for further improvement, as regards charging stability, low-temperature fixability, image gloss, and fixing wrapping resistance in cases where the toner is used in high-speed machines, such as in POD.

CITATION LIST

Patent Literature

[Patent Literature 1] Japanese Patent Application Publication No. H7-209910

[Patent Literature 2] Japanese Patent Application Publication No. 2000-330325

[Patent Literature 3] Japanese Patent Application Publication No. 2007-279239

DISCLOSURE OF INVENTION

Technical Problems

An object of the present invention is to provide a toner in which the above problems are solved. Specifically, it is an object of the present invention to provide a toner having excellent charging stability, low-temperature fixability, image gloss and fixing wrapping resistance.

Solution to Problem

The present invention relates to a toner comprising toner particles, each of which contains a binder resin, a wax and inorganic fine particles, wherein the inorganic fine particles are fixed at the surface of the toner particles as a result of a surface treatment by hot air, and the toner satisfies the following formula (1):

$$1.20 \leq P1/P2 \leq 2.00 \quad (1)$$

in the formula (1), P1=Pa/Pb and P2=Pc/Pd, wherein,

Pa is an intensity of the highest absorption peak in a range from 2843 $cm^{-1}$ to 2853 $cm^{-1}$, and Pb is an intensity of the highest absorption peak in a range from 1713 $cm^{-1}$ to 1723 $cm^{-1}$ in an FT-IR spectrum obtained by an attenuated total reflectance (ATR) method by using Ge as the ATR crystal and under the condition of an infrared light-incidence angle of 45°, and wherein Pc is an intensity of the highest absorption peak in a range from 2843 $cm^{-1}$ to 2853 $cm^{-1}$, and Pd is an intensity of the highest absorption peak in a range from 1713 $cm^{-1}$ to 1723 $cm^{-1}$ in an FT-IR spectrum obtained by an attenuated total reflectance (ATR) method by using KRS5 as the ATR crystal and under the condition of an infrared light-incidence angle of 45°.

Advantageous Effects of Invention

The present invention succeeds in providing a toner that satisfies charging stability, low-temperature fixability, image gloss and fixing wrapping resistance.

BRIEF DESCRIPTION OF DRAWINGS

FIG. 1 is a schematic cross-sectional diagram of a toner surface treatment apparatus.

MODE FOR CARRYING OUT THE INVENTION

The toner of the present invention comprises toner particles, each of which contains a binder resin, a wax and inorganic fine particles, such that the inorganic fine particles are fixed at the surface of the toner particles as a result of a surface treatment by hot air. The charging stability of toner can be enhanced by virtue of such a feature.

Conventionally, the triboelectric charge of toner was controlled by adjusting the type and amount of external additives that are used in toners. However, by virtue of the stress for the toner in a developing device, the external additive may eliminate from the toner in instances where 1000 prints of an image having a high image printing ratio (for instance, image printing ratio of 80 area %) are printed continuously, in one job, using such a toner. Changes in triboelectric charge quantity of the toner become significant as a result. In the present invention, by contrast, the inorganic fine particles are fixed to the surface of the toner particles as a result of a surface treatment by hot air, elimination of the inorganic fine particles is therefore suppressed. The present invention, as a result, allows suppressing changes in the triboelectric charge quantity of toner, even under printing conditions such as the above-described ones.

Preferably, the inorganic fine particles used in the present invention are one or more types of inorganic fine particles selected from the group consisting of silica fine particles, titanium oxide fine particles and aluminum oxide fine particles. Preferably, the inorganic fine particles are subjected to a hydrophobic treatment by a hydrophobizing agent such as a silane compound, silicone oil, or a mixture thereof.

The specific surface area of the inorganic fine particles ranges preferably from 5 $m^2/g$ to 80 $m^2/g$, more preferably from 10 $m^2/g$ to 60 $m^2/g$. Elimination of inorganic fine particles from the toner particles can be suppressed if the specific surface area of the inorganic fine particles lies within the abovementioned range. Accordingly, there decreases the change in triboelectric charge quantity of the toner as a result of endurance printing. The low-temperature fixability of the toner as well as the gloss and fixing wrapping resistance of the image are also improved. It is preferable that two or more types of inorganic fine particles selected from the group consisting of silica fine particles, titanium oxide fine particles and aluminum oxide fine particles are fixed on the surface of the toner particles by a surface treatment of hot air. In this case, the specific surface area of first inorganic fine particles ranges preferably from 5 $m^2/g$ to 80 $m^2/g$, and the specific surface area of second inorganic fine particles ranges preferably from 80 $m^2/g$ to 500 $m^2/g$. Further, it is preferable that first inorganic fine particles are silica fine particles, and second inorganic fine particles are titanium oxide fine particles. By using two or more types of inorganic fine particles above mentioned, the triboelectric charging stability of the toner is further improved. Preferably, the addition amount of the inorganic fine particles ranges from 0.5 parts by mass to 20 parts by mass with respect to 100 parts by mass of particles before the treatment with inorganic fine particles. An addition amount of inorganic fine particles lying within the abovementioned range allows suppressing elimination of the inorganic fine particles, and allows obtaining a desired triboelectric charge quantity of the toner. Also, wax seeping during fixing is good, and hence the gloss and fixing wrapping resistance of the image are likewise good.

As a characterizing feature, the toner of the present invention satisfies the following formula (1).

$$1.20 \leq P1/P2 \leq 2.00 \quad (1)$$

In the formula (1), P1 is an index relating to the abundance ratio of wax with respect to the binder resin at about 0.3 μm from the toner surface, in a depth direction of the toner that extends from the toner surface towards a toner central portion, and P2 is an index relating to the abundance ratio of wax with respect to the binder resin at about 1.0 μm from the toner surface, in a depth direction of the toner that extends from the toner surface towards a toner central portion.

In a characterizing feature of the present invention, the index (P1) relating to the abundance ratio of the wax with respect to the binder resin at about 0.3 μm from the toner surface, is set to be greater than the index (P2) relating to the abundance ratio of wax with respect to the binder resin at about 1.0 μm from the toner surface, and there is controlled an index ratio [P1/P2] relating to the foregoing abundance ratios (i.e. there is controlled the degree of uneven distribution of wax in a depth direction of the toner, from the toner surface towards a toner central portion).

It is deemed that controlling [P1/P2] so as to lie within the above-described range allows the wax that is abundant in the vicinity of the toner surface to promote, during fixing, seeping of wax that is present further towards the central portion than the vicinity of the toner surface. That is because melting of wax present in the vicinity of the toner surface causes passages to be formed through which wax can migrate from the interior of the toner towards a toner surface, so that wax seeps effectively during fixing. Toner releasability can be increased thanks to the seeping wax, and fixing wrapping resistance can be improved as a result.

When [P1/P2] is smaller than 1.20, the wax seeping speed during fixing is slow. Accordingly, image gloss is poor, and fixing wrapping resistance low, in a case where such a toner is used in devices where high-speed image formation is performed, such as in POD. When [P1/P2] exceeds 2.00, by contrast, excessive wax is present in the vicinity of the toner surface; as a result, fixing wrapping resistance improves, but toner fluidity decreases, and changes in the triboelectric charge quantity of toner become more substantial. This gives rise to image density fluctuation and white background fogging.

Preferably, the [P1/P2] of the toner ranges from 1.25 to 1.90, and more preferably from 1.30 to 1.80.

The [P1/P2] of conventional pulverized toner or polymerized toner was smaller than 1.00, and thus it was necessary to add a substantial amount of wax in order to enhance toner releasability. This resulted, in some cases, in changes in the triboelectric charge quantity of toner through embedding and/or elimination of the external additive, and in density fluctuation and white background fogging.

The P1/P2 value of conventional toner spherized as a result of a surface treatment by hot air was greater than 2.00. That is because, unless special measures are taken, a thermal treatment of toner particles causes wax to come out to the surface of the toner particles on account of even a small amount of heat. The P1/P2 value exceeds thus 2.00 before spherization of the toner.

The [P1/P2] of the toner can be controlled so as to lie within the prescribed range by controlling P1 and P2 independently. Means for controlling P1 and P2 independently are described below.

A method for calculating the [P1/P2] of toner is as follows.

In an FT-IR spectrum that can be obtained by an attenuated total reflectance (ATR) method by using Ge as the ATR crystal and under the condition of an infrared light-incidence angle of 45°, Pa denotes an intensity of the highest absorption peak in a range from 2843 $cm^{-1}$ to 2853 $cm^{-1}$ and Pb denotes an intensity of the highest absorption peak in a range from 1713 $cm^{-1}$ to 1723 $cm^{-1}$. In an FT-IR spectrum that can be obtained by an attenuated total reflectance (ATR) method by using KRS5 as the ATR crystal and under the condition of an infrared light-incidence angle of 45°, Pc denotes an intensity of the highest absorption peak in a range from 2843 $cm^{-1}$ to 2853 $cm^{-1}$ and Pd denotes an intensity of the highest absorption peak in a range from 1713 $cm^{-1}$ to 1723 $cm^{-1}$. Herein, P1 and P2 are calculated as P1=Pa/Pb and P2=Pc/Pd.

The intensity of the highest absorption peak Pa is the value resulting from subtracting the average value of absorption intensity at 3050 $cm^{-1}$ and 2600 $cm^{-1}$ from the maximum value of the absorption peak intensity in the range from 2843 $cm^{-1}$ to 2853 $cm^{-1}$.

The intensity of the highest absorption peak Pb is the value resulting from subtracting the average value of the absorption intensity at 1763 $cm^{-1}$ and 1630 $cm^{-1}$ from the maximum value of the absorption peak intensity in the range from 1713 $cm^{-1}$ to 1723 $cm^{-1}$.

The intensity of the highest absorption peak Pc is the value resulting from subtracting the average value of the absorption intensity at 3050 $cm^{-1}$ and 2600 $cm^{-1}$ from the maximum value of the absorption peak intensity in the range from 2843 $cm^{-1}$ to 2853 $cm^{-1}$.

The intensity of the highest absorption peak Pd is the value resulting from subtracting the average value of the absorption intensity at 1763 $cm^{-1}$ and 1630 $cm^{-1}$ from the maximum value of the absorption peak intensity in the range from 1713 $cm^{-1}$ to 1723 $cm^{-1}$.

In the FT-IR spectrum, the absorption peak in the range from 1713 $cm^{-1}$ to 1723 $cm^{-1}$ is a peak attributed to the stretching vibration of —CO— mainly originating from the binder resin.

Peaks derived from the binder resin are detected in the form of various peaks, for instance, out-of-plane bending vibration of CH in the aromatic ring, other than the abovementioned —CO— derived peak. However, multiple peaks are present at or below 1500 $cm^{-1}$, and it is difficult to isolate the peaks of the binder resin alone. Accurate numerical values cannot thus be calculated. Accordingly, binder resin-derived peaks that are used are absorption peaks in the range from 1713 $cm^{-1}$ to 1723 $cm^{-1}$, at which separation from other peaks is easy.

In the FT-IR spectrum, the absorption peak in the range from 2843 $cm^{-1}$ to 2853 $cm^{-1}$ is caused by stretching vibration (symmetrical) of —$CH_2$— derived mainly from the wax.

Besides the abovementioned —$CH_2$— derived peak, the in-plane bending vibration peak of $CH_2$ is also detected in a range from 1450 $cm^{-1}$ to 1500 $cm^{-1}$ as a wax peak. However, this peak overlaps with binder resin-derived peaks, and thus it is difficult to separate the wax peak. Accordingly, an absorption peak in the range from 2843 $cm^{-1}$ to 2853 $cm^{-1}$, at which separation from other peaks is easy, is used as a wax-derived peak.

The average value of the absorption intensity at 3050 $cm^{-1}$ and 2600 $cm^{-1}$ is subtracted from the maximum value of the absorption peak intensity ranging from 2843 $cm^{-1}$ to 2853 $cm^{-1}$, to work out Pa and Pc, for the purpose of calculating a true peak intensity, excluding the influence of the baseline.

Ordinarily, no absorption peaks are found in the vicinity of 3050 $cm^{-1}$ and 2600 $cm^{-1}$. Therefore, a baseline intensity can be calculated by calculating an average value of these two points. The same reason underlies the subtraction of the average value of absorption intensity at 1763 $cm^{-1}$ and 1630 $cm^{-1}$ from the maximum value of the absorption peak intensity ranging from 1713 $cm^{-1}$ to 1723 $cm^{-1}$, when working out Pb and Pd.

The binder resin-derived maximum absorption peak intensities (Pb, Pd) and the wax-derived maximum absorption peak intensities (Pa, Pc) are correlated to be abundance of binder resin and wax. In the present invention, the abundance ratio of wax relative to binder resin is calculated by dividing the wax-derived maximum absorption peak intensities by the binder resin-derived maximum absorption peak intensities.

In order to impart releasability from the fixing member, it is important that a release layer be formed between the fixing member and a toner layer through seeping of wax during fixing.

However, the fusion time of the toner in the fixing process is short in the case of a high-speed machine, such as in POD. Accordingly, the wax seeping time is short, and a sufficient release layer fails to be formed. Fixation wrapping resistance becomes poorer as a result. Accordingly, it is necessary to add a substantial amount of wax in order to cope with a device where high-speed image formation is carried out, such as in POD. In this case, however, changes in triboelectric charge quantity, due to elimination and/or embedding of the external additive, become substantial, and there occurs density fluctuation and white background fogging.

As a result of diligent research, the inventors found that P1 is correlated to image gloss and fixing wrapping resistance. The underlying reasons are deemed to be as follows. Adjusting P1 to lie within an appropriate range results in an appropriate large abundance ratio of wax with respect to the binder resin at about 0.3 μm, in the depth direction, from the toner surface. Melting of this wax promotes seepage of wax at the central portion of the toner. As a result, wax melts quickly, and seeps out in sufficient amount, during the fixing step, also in devices where high-speed image formation is carried out, such as in POD. A release effect is elicited thereby that affords good releasablity between the fixing member and the toner layer.

Specifically, P1 ranges preferably from 0.10 to 0.70, more preferably from 0.12 to 0.66.

In the present invention, it was found that the state in which the wax is present is important in order to bring out a release effect during the fixing process. Specifically, there is a correlation between the wax abundance ratio at about 0.3 μm and wax seepage behavior. Accordingly, the wax abundance ratio at about 0.3 μm was set to P1 in the present invention.

It is possible to control P1 so as to lie within a prescribed range by modifying the treatment conditions in the surface treatment by hot air, and/or by controlling the type and addition amount of the wax that is contained in the toner particles before a thermal treatment. For instance, conceivable ways of increasing P1 may involve rising the temperature of the surface treatment by hot air, and/or increasing the addition amount of wax, while conceivable ways of reducing P1 may involve lowering the temperature of the surface treatment by hot air, and/or reducing the addition amount of wax. When P1 is modified in accordance with some of the above procedures, however, the rate of change of P1 becomes excessive, and thus P1 becomes very difficult to control. In addition to the abovementioned methods, preferably, there is also controlled the dispersion state of the wax. The rate of change of P1 is controlled thereby. For instance, wax dispersibility can be controlled through internal addition of inorganic fine particles into toner particles and through a thermal treatment.

Controlling P1 so as to lie within a prescribed range is important to enhance the gloss and/or the fixing wrapping resistance of the image. However, the wax has a lower molecular weight than that of the binder resin, and is hence soft. As a result, there occurred density fluctuation and white background fogging, on account of changes in the triboelectric charge quantity through endurance printing, even with P1 lying within a prescribed range.

Preferably, therefore, the abundance ratio (P2) of wax with respect to the binder resin at about 1.0 μm in the depth direction from the toner surface is also controlled, to improve thereby the stability of the triboelectric charge quantity of the toner and the charge-providing member.

In the present invention, it was found that suppressing embedding of the inorganic fine particles that are used in the toner is important in order to achieve stability of triboelectric charge quantity of the toner and a charge-providing member. Specifically, there was a correlation between suppression of embedding of inorganic fine particles and the wax abundance ratio at about 1.0 μm. Accordingly, the wax abundance ratio at about 1.0 μm was set to P2 in the present invention.

The underlying mechanism for the above is not clear, but the inventors speculate as follows.

Suppressing changes in the toner surface as a result of endurance printing is important in order to suppress changes over time in the triboelectric charge quantity of the toner and the charge-providing member. Specifically, it is important to suppress embedding and elimination of inorganic fine particles on account of stress in the developing device.

Embedding of inorganic fine particles is deemed to be determined not only by the hardness of the toner surface but also by the hardness of the layer that underlies the surface. For instance, it is deemed that, even if there is a high abundance of wax at the outermost layer of the toner, the inorganic fine particles will not become embedded, to such an extent as to lose their functionality, if the underlying layer of the outermost layer is made up of a hard resin. Therefore, the abundance ratio (P2) of wax with respect to the binder resin at about 1.0 μm in the depth direction from the toner surface is important. It is deemed that controlling P2 so as to lie within a specific range may allow controlling embedding of the inorganic fine particles and suppress changes in triboelectric charge quantity.

Specifically, P2 ranges preferably from 0.05 to 0.35, more preferably from 0.06 to 0.33.

Further, P2 can be controlled so as to lie within a prescribed range through modification of the type and addition amount of the wax, modification of the dispersion diameter of the wax in the toner, and modification of the conditions of the surface treatment by hot air. The dispersion diameter of the wax in the toner can also be modified, for instance, by using the inorganic fine particles as an internal additive.

The wax used in the toner of the present invention is not particularly limited, and may be any of the following. For instance, a hydrocarbon wax such as low-molecular weight polyethylene, low-molecular weight polypropylene, alkylene copolymers, microcrystalline wax, paraffin wax, Fischer-Tropsch wax or the like; oxides of hydrocarbon waxes, such as polyethylene oxide wax, or block copolymers thereof; waxes having an aliphatic ester as a main component, for instance carnauba wax; or products resulting from partially or completely de-oxidizing aliphatic esters, such as deoxidized carnauba wax. Further examples include the following: saturated straight-chain fatty acids such as palmitic acid, stearic acid or montanoic acid; unsaturated fatty acids such a brassidic acid, eleostearic acid, parinaric acid or the like; saturated alcohols such as stearyl alcohol, aralkyl alcohol, behenyl alcohol, carnaubyl alcohol, ceryl alcohol, melissyl alcohol or the like; polyhydric alcohols such as sorbitol; esters of fatty acids such as palmitic acid, stearic acid, behenic acid, montanoic acid or the like with an alcohol such as stearyl alcohol, aralkyl alcohols, behenyl alcohol, carnaubyl alcohol, ceryl alcohol, melissyl alcohol or the like; aliphatic amides such as linoleic acid amide, oleic acid amide, lauric acid amide or the like; saturated aliphatic bisamides such as methylene bis (stearic acid amide), ethylene bis(caprylic acid amide), ethylene bis(lauric acid amide), hexamethylene bis(stearic acid amide) or the like; unsaturated aliphatic acid amides such as ethylene bis(oleic acid amide), hexamethylene bis(oleic acid amide), N,N'-dioleyladipic acid amide, N,N'-dioleylsebacic acid amide or the like; aromatic bisamides such as m-xylene bis(stearic acid amide) and N,N'-distearylisophthalic acid amide; fatty acid metal salts (ordinarily called metal soaps) such as calcium stearate, calcium laurate, zinc stearate and magnesium stearate; grafted waxes obtained by grafting vinyl monomers such as styrene or acrylic acid to aliphatic hydrocarbon waxes; partially esterified products of polyhydric alcohols with fatty acids such as monoglyceride behenate; and methyl ester products having hydroxyl groups, obtained by hydrogenation of vegetable fats and oils.

Preferred among the foregoing is a hydrocarbon wax, such as a paraffin wax or Fischer-Tropsch wax, in terms of enhancing low-temperature fixability and fixing wrapping resistance.

The content of wax ranges preferably from 0.5 parts by mass to 20 parts by mass with respect to 100 parts by mass of the binder resin. From the viewpoint of balancing toner storability and hot offset properties, preferably, the wax exhibits a peak temperature of the highest endothermic peak of from at least 50° C. to not more than 110° C., in an endothermic curve upon rise of temperature as measured using a differential scanning calorimeter (DSC) in a temperature range from 30° C. to 200° C.

The binder resin used in the toner of the present invention is not particularly limited, and may be any of the following:

a homopolymer of styrene and substituted styrene, for instance polystyrene, poly-p-chlorostyrene, polyvinyl toluene or the like; a styrenic copolymer, for instance a styrene-p-chlorostyrene-copolymer, a styrene-vinyl toluene copolymer, a styrene-vinyl naphthalene copolymer, a styrene-acrylate copolymer, a styrene-methacrylate copolymer, a styrene-α-chloromethyl methacrylate copolymer, a styrene-acrylonitrile copolymer, a styrene-vinyl methyl ether copolymer, a styrene-vinyl ethyl ether copolymer, a styrene-vinyl methyl ketone copolymer, a styrene-acrylonitrile-indene copolymer or the like; as well as polyvinyl chloride, a phenolic resin, a natural modified phenol resin, a natural-resin modified maleic acid, an acrylic resin, a methacrylic resin, polyvinyl acetate, a silicone resin, a polyester resin, polyurethane, a polyamide resin, a furan resin, an epoxy resin, a xylene resin, polyvinyl butyral, a terpene resin, a coumarone-indene resin or a petroleum resin.

A polyester resin is preferably used, among the foregoing in terms of low-temperature fixability and charging performance control. Examples of the monomers that make up a polyester resin include, for instance, a dihydric or higher alcohol monomer component, a di- or higher carboxylic acid, a di- or higher carboxylic acid anhydride and a di- or higher carboxylic acid ester. Examples of dihydric or higher alcohol monomer components include, for instance, the following: alkylene oxide adducts of bisphenol A such as polyoxypropylene (2.2)-2,2-bis(4-hydroxyphenyl) propane, polyoxypropylene (3.3)-2,2-bis(4-hydroxyphenyl) propane, polyoxyethylene (2.0)-2,2-bis(4-hydroxyphenyl) propane, polyoxypropylene (2.0)-polyoxyethylene (2.0)-2,2-bis(4-hydroxyphenyl) propane, polyoxypropylene (6)-2,2-bis(4-hydroxyphenyl) propane; as well as ethylene glycol; diethylene glycol; triethylene glycol; 1,2-propylene glycol; 1,3-propylene glycol; 1,4-butanediol; neopentyl glycol; 1,4-butene diol; 1,5-pentanediol; 1,6-hexanediol; 1,4-cyclohexanedimethanol; dipropylene glycol; polyethylene glycol; polypropylene glycol; polytetramethylene glycol; sorbitol; 1,2,3,6-hexanetetrol; 1,4-sorbitan; pentaerythritol; dipentaerythritol; tripentaerythritol; 1,2,4-butane triol; 1,2,5-pentane triol; glycerol; 2-methylpropane triol; 2-methyl-1,2,4-butane triol; trimethylol ethane; trimethylolpropane and 1,3,5-trihydroxymethylbenzene.

Aromatic diols are preferably used among the foregoing. Preferably, the alcohol monomer component that makes up the polyester resin contains an aromatic diol in a proportion of 80 mol % or higher. Examples of acid monomer components such as di- or higher carboxylic acids, di- or higher carboxylic acid anhydrides and di- or higher carboxylic acid esters include, for instance, the following: aromatic dicarboxylic acids such as phthalic acid, isophthalic acid and terephthalic acid, and anhydrides thereof; alkyl dicarboxylic acids such as succinic acid, adipic acid, sebacic acid and azelaic acid, as well as anhydrides thereof; succinic acid substituted with a C6 to C18 alkyl group or alkenyl group, as well as anhydrides thereof; and unsaturated dicarboxylic acids such as fumaric acid, maleic acid, citraconic acid as well as anhydrides thereof. Among the foregoing there are used, preferably, terephthalic acid, succinic acid, adipic acid, fumaric acid, trimellitic acid, pyromellitic acid or benzophenone tetracarboxylic acid, as well as anhydrides thereof.

Preferably, the acid value of the polyester resin ranges from 1 mgKOH/g to 20 mgKOH/g, in terms of stability of the triboelectric charge quantity. The acid value of the polyester resin can be brought to lie within the abovementioned range by adjusting the type and/or blending amount of the monomer that is used in the polyester resin. Specifically, the acid value can be obtained by adjusting the alcohol monomer component ratio/acid monomer component ratio and molecular weight during production of the resin. To control the acid value, the terminal alcohols are reacted with a polyhydric acid monomer (for instance, trimellitic acid), after condensation polymerization of the ester.

Examples of the colorant that can be contained in the toner of the present invention include the following.

For instance, carbon black may be used as a black colorant. Alternatively, the black colorant may be obtained by mixing a yellow colorant, a magenta colorant and a cyan colorant. A pigment may be used singly as the colorant, but, from the viewpoint of the quality of full-color image, a dye and a pigment are preferably used concomitantly, to enhance thereby cleanness of the color.

Examples of magenta color pigments include, for instance, the following: C. I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238, 269, 282; C. I. Pigment Violet 19; and C.I. Vat Red 1, 2, 10, 13, 15, 23, 29, 35.

Examples of magenta color dyes include, for instance, the following: C. I. Solvent Red 1, 3, 8, 23, 24, 25, 27, 30, 49, 81, 82, 83, 84, 100, 109, 121; C. I. Disperse Red 9; C. I. Solvent Violet 8, 13, 14, 21, 27; a oil-soluble dye such as C. I. Disperse Violet 1, C.I. Basic Red 1, 2, 9, 12, 13, 14, 15, 17, 18, 22, 23, 24, 27, 29, 32, 34, 35, 36, 37, 38, 39, 40; and a basic dye such as C.I. Basic Violet 1, 3, 7, 10, 14, 15, 21, 25, 26, 27, 28.

Examples of cyan color pigments include, for instance, the following: C. I. Pigment Blue 2,3,15:2,15:3,15:4,16,17; C. I. Vat Blue 6; C. I. Acid Blue 45, and copper phthalocyanine pigments wherein a phthalocyanine skeleton is substituted with one to five phthalimide methyl groups.

Cyan color dyes include, for instance, C.I. Solvent Blue 70.

Examples of yellow color pigments include, for instance, the following: C. I. Pigment Yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181, 185; and C.I. Vat Yellow 1, 3, 20.

Yellow color dyes include, for instance, C.I. Solvent Yellow 162.

The use amount of the abovementioned colorant ranges preferably from 0.1 parts by mass to 30 parts by mass with respect to 100 parts by mass of the binder resin.

The toner of the present invention can contain a charge control agent, as the case may require. A known charge control agent can be used as the charge control agent in the toner. Preferably, however, there is used a metal compound of an aromatic carboxylic acid that is colorless, affords fast charging speed of the toner, and allows maintaining stably a constant charge quantity.

Examples of negative-type charge control agents include, for instance, salicylic acid metal compounds, naphthoic acid metal compounds, dicarboxylic acid metal compounds, polymer compounds having sulfonic acid or a carboxylic acid in a side chain, polymer compounds having a sulfonic acid salt or a sulfonic acid ester in a side chain, polymer compounds having a carboxylic acid salt or a carboxylic acid ester in a side chain, boron compounds, urea compounds, silicon compounds or calixarene compounds. Examples of positive-type charge control agents include, for instance, quaternary ammonium salts, polymer compounds having such a quaternary ammonium salt in a side chain, guanidine compounds, and imidazole compounds. The charge control agent may be added, to the toner particles, in the form of an internal additive or an external additive. The addition amount of the charge control agent ranges preferably from 0.2 parts by mass to 10 parts by mass with respect to 100 parts by mass of the binder resin.

In the present invention, inorganic fine particles are fixed at the surface of toner particles. However, an external additive may be further added to the toner particles in order to enhance fluidity and/or adjust triboelectric charge quantity.

The external additive is, preferably, silica, titanium oxide, aluminum oxide or strontium titanate. Preferably, the external additive is subjected to a hydrophobic treatment by a hydrophobizing agent such as a silane compound, silicone oil, or a mixture thereof.

Preferably, the specific surface area of the external additive that is used ranges from 10 $m^2/g$ to 50 $m^2/g$, in terms of suppressing embedding of external additive.

The external additive is preferably used in an amount ranging from 0.1 parts by mass to 5.0 parts by mass with respect to 100 parts by mass of the toner particles.

The toner particles and the external additive may be mixed using conventional mixing equipment, such as a Henschel mixer.

The toner of the present invention is spherized by being subjected to a surface treatment by hot air. The toner of the present invention has preferably an average circularity ranging from 0.960 to 0.980, resulting from analyzing, 800 divisions within a circularity range from 0.200 to 1.000, particles having a circle-equivalent diameter from 1.98 μm to less than 39.69 μm as measured by a flow-type particle image measuring device at an image processing resolution of 512×512 pixels (0.37 μm×0.37 μm per pixel).

High transfer efficiency can be maintained if the average circularity of the toner lies within the abovementioned range, even in a case where an intermediate transfer member is used.

Preferably, the proportion of particles in the toner having a circle-equivalent diameter ranging from 0.50 μm to less than 1.98 μm (hereafter also referred to as small-particle toner) with respect to the total of particles having a circle-equivalent diameter ranging from 0.50 μm to less than 39.69 μm is no greater than 15.0 number %, as measured by a flow-type particle image measuring device at an image processing resolution of 512×512 pixels (0.37 μm×0.37 μm per pixel). More preferably, the proportion of the abovementioned small-particle toner is no greater than 10.0 number %, and particularly preferably no greater than 5.0 number %.

A proportion of small-particle toner no greater than 15.0 number % allows reducing adhesion of small-particle toner to a magnetic carrier. As a result, this allows maintaining the charging stability of the toner in endurance printing over long periods of time.

The proportion of the small-particle toner can be controlled by way of the toner production method or sorting method.

The toner of the present invention can be used as a one-component developer, or as a two-component developer mixed with a magnetic carrier.

Examples of magnetic carriers include, for instance, the following: metal particles of iron, lithium, calcium, magnesium, nickel, copper, zinc, cobalt, manganese and rare earth, or alloy particles of the foregoing, as well as oxide particles and ferrite; or a magnetic material dispersion resin carrier that contains a magnetic material and a binder resin.

In a case where the toner of the present invention is used as a two-component developer mixed with a magnetic carrier, the concentration of the toner in the developer ranges preferably from 2 mass % to 15 mass %. More preferably, the toner concentration in the developer ranges from 4 mass % to 13 mass %.

The method for producing the toner of the present invention is not particularly limited, and a known production method can be used. A production method of toner relying on a pulverization method will be explained herein.

In a starting material mixing step, predetermined amounts of components such as, for instance, the binder resin and the wax and, as the case may require, a colorant, a charge control agent and the like, as the materials that make up the toner particles, are weighed, blended and mixed. Examples of mixing devices include, for instance, double-cone mixers, V-type mixers, drum-type mixers, supermixers, Henschel mixers, Nauta mixers or a Mechano Hybrid mixer (by Nippon Coke & Engineering. Co., Ltd).

Next, the mixed material is melt-kneaded, to disperse the wax and so forth in the binder resin. In the melt kneading step there can be used a batch kneader such as pressure kneader or a Banbury mixer, or a continuous-type kneader. Herein single- or twin-screw extruders are used as mainstream equipment on account of their superiority in terms of enabling continuous production. Examples thereof include, for instance, a KTK-type twin-screw extruder (by Kobe Steel, Ltd.), a TEM-type twin-screw extruder (by Toshiba Machine Co., Ltd.), a PCM mixer (by Ikegai Iron Works Co), a twin-screw extruder (by KCK Co.), Ko-kneader (by Buss AG), and Kneadex (by Nippon Coke & Engineering Co., Ltd.). The resin composition obtained by melt-kneading may be rolled using twin rolls or the like, and may be cooled with water or the like in a cooling step.

The cooled product of the resin composition is pulverized then to a desired particle size, in a pulverization step. In the pulverization step, coarse pulverization is performed using pulverization equipment such as a crusher, a hammer mill, a feather mill or the like. This is followed by fine pulverization using a Kryptron System (by Kawasaki Heavy Industries Ltd.), Super Rotor (by Nisshin Engineering Inc.), Turbo Mill (by Turbo Kogyou Co., Ltd.), or an air-jet pulverizer.

Thereafter, the pulverized product is sorted, as the case may require, using sorting and sieving equipment Elbow-Jet (by Nittetsu Mining Co., Ltd.) relying on inertial sorting, Turboplex (by Hosokawa Micron Corporation) relying on centrifugal sorting, a TSP separator (by Hosokawa Micron Corporation), and Faculty (by Hosokawa Micron Corporation), to yield particles.

As the case may require, pulverization can be followed by a surface treatment such as spherizing treatment, using a Hybridization System (by Nara Machinery Co., Ltd.), a Mechanofusion system (by Hosokawa Micron Corporation), Faculty (by Hosokawa Micron Corporation), and Meteo Rainbow MR Type (by Nippon Pneumatic Mfg. Co., Ltd).

In the present invention, preferably, the inorganic fine particles are dispersed in the surface of the particles before the treatment of the inorganic fine particles, and, in that dispersed state, the inorganic fine particles are fixed to the surface of the toner particles by being subjected to a surface treatment by hot air. The method for dispersing the inorganic fine particles in the particle surface can involve using a known mixer such as a Henschel mixer. The particles subjected to the surface treatment by hot air are also referred to hereafter as starting material toner.

In the present invention, preferably, the surface treatment of the starting material toner is performed using a surface treatment apparatus such as the one illustrated in FIG. 1. An explanation follows next on a surface treatment method that utilizes the surface treatment apparatus illustrated in FIG. 1. In the surface treatment by hot air, starting material toner is jetted out of a high-pressure air supply nozzle, and the jetted starting material toner is exposed to hot air, to treat thereby the surface of the starting material toner. Specifically, the method is as follows. Starting material toner (114) supplied from the toner feeding port (100) is accelerated by injection air that is jetted from a high-pressure air supply nozzle (115), and the starting material toner (114) flies towards an airflow jetting member (102) disposed below. Scattering air is jetted from the airflow jetting member (102), and the starting material toner is scattered towards the exterior by this scattering air. The scattering state of the starting material toner at this time can be controlled through regulation of the flow rate of injection air and the flow rate of scattering air.

With a view to preventing melt adhesion of the starting material toner, a cooling jacket (106) is provided on the outer periphery of the toner feeding port (100), the outer periphery of the surface treatment apparatus and the outer periphery of a transport pipe (116). Preferably, cooling water (preferably, an antifreeze such as ethylene glycol) is caused to pass through the cooling jacket. The starting material toner scattered by the scattering air is subjected to a surface treatment by hot air that is supplied by the hot air feeding port (101). Preferably, the hot air temperature C (° C.) ranges from 100° C. to 450° C. More preferably, the hot air temperature C (° C.) ranges from 100° C. to 400° C., in particular, from 150° C. to 300° C.

When the temperature of the hot air lies within the abovementioned range, it becomes possible to suppress variability on the surface roughness of the surface of the toner particles, and to suppress melt adhesion and coarsening of the toner particles through aggregation of starting material toner particles with each other. It becomes likewise easy to control the [P1/P2] of the toner so as to lie within the range prescribed in the present invention.

The toner particles the surface whereof has been treated by hot air are cooled then by cold air supplied from the cold air feeding port (103) that is provided on the upper outer periphery of the apparatus. Herein, cold air may be introduced through a second cold air feeding port (104) that is provided on a side face of the main body of the apparatus, with a view to controlling the temperature distribution within the apparatus and controlling the surface state of the toner. The shape of the outlet of the second cold air feeding port (104) may be, for instance, a slit shape, a louver shape, a perforated plate shape or a mesh shape. The direction into which the cold air is introduced may be a direction towards the center of the apparatus, or a direction towards the wall face of the apparatus. The temperature E (° C.) of the cold air ranges preferably from −50° C. to 10° C., more preferably from −40° C. to 8° C. The cold air is preferably dehumidified cold air. Specifically, the absolute moisture content of the cold air is preferably no greater than 5 g/m$^3$, more preferably no greater than 3 g/m$^3$.

When the temperature E of cold air lies within temperature the abovementioned range, it becomes possible to suppress aggregation between particles while preventing drops of temperature within the apparatus. An absolute moisture content of cold air lying within the above-described range enables preventing drops in the seeping rate of the wax through a rise in the hydrophilicity of cold air, and enables the [P1/P2] of the toner to be easily controlled so as to lie within the range prescribed in the present invention.

The cooled toner particles are aspirated by a blower, pass through the transport pipe (116), and are recovered in a cyclone or the like.

As the case may require, the recovered particles may be subjected to further surface modification and a spherizing treatment using, for instance, a Hybridization System (by Nara Machinery Co., Ltd.), Mechanofusion system (by Hosokawa Micron Corporation). In this case there may be used a sieving machine, e.g., a wind power sieve Hi-Bolter (by Shin Tokyo Kikai K.K.), as the case may require.

An explanation follows next on methods for measuring the various properties of toner and starting materials.

<Calculation Method of P1 and P2>

Measurements of an FT-IR spectrum in accordance with the ATR (Attenuated Total Reflectance) method are performed using a Fourier transform infrared spectrometer (Spectrum One by Perkin Elmer) equipped with a Universal ATR measurement accessory (Universal ATR sampling accessory). The specific measurement procedure and the calculation method of P1 and P2 were as follows.

The incidence angle of infrared light (λ=5 μm) is set to 45°. As the ATR crystal there are used a Ge ATR crystal (refractive index=4.0) and a KRS5 ATR crystal (refractive index=2.4). Other conditions are as follows.

Range

Start: 4000 cm$^{-1}$

End: 600 cm$^{-1}$ (Ge ATR crystal), 400 cm$^{-1}$ (KRS5 ATR crystal) Duration

Scan number: 16

Resolution: 4.00 cm$^{-1}$

Advanced: with $CO_2$/$H_2O$ correction

[Calculation Method of P1]

(1) An ATR crystal (refractive index=4.0) of Ge is fitted to the device.

(2) Scan type is set to Background, Units are set to EGY, and the background is measured.

(3) Scan type is set to Sample, and Units is set to A.

(4) There are precisely measured 0.01 g of toner on the ATR crystal.

(5) The sample is pressed with a pressure arm (Force Gauge is 90).

(6) The sample is measured.

(7) The obtained FT-IR spectrum is subjected to baseline correction by Automatic Correction.

(8) A maximum value of absorption peak intensity in the range from 2843 cm$^{-1}$ to 2853 cm$^{-1}$ is calculated. (Pa1)

(9) The average value of absorption intensity at 3050 cm$^{-1}$ and at 2600 cm$^{-1}$ is calculated. (Pa2)

(10) Pa1−Pa2=Pa. The abovementioned Pa is defined as the intensity of the highest absorption peak in the range from 2843 cm$^{-1}$ to 2853 cm$^{-1}$.

(11) A maximum value of absorption peak intensity in the range from 1713 cm$^{-1}$ to 1723 cm$^{-1}$ is calculated. (Pb1)

(12) The average value of absorption intensity at 1763 cm$^{-1}$ and at 1630 cm$^{-1}$ is calculated. (Pb2)

(13) Pb1−Pb2=Pb. The abovementioned Pb is defined as the intensity of the highest absorption peak in the range from 1713 cm$^{-1}$ to 1723 cm$^{-1}$.

(14) Pa/Pb−P1.

[Calculation Method of P2]

(1) An ATR crystal (refractive index=2.4) of KRS5 is fitted to the device.

(2) There are precisely measured 0.01 g of toner on the ATR crystal.

(3) The sample is pressed with a pressure arm (Force Gauge is 90).

(4) The sample is measured.

(5) The obtained FT-IR spectrum is subjected to baseline correction by Automatic Correction.

(6) A maximum value of absorption peak intensity in the range from 2843 cm$^{-1}$ to 2853 cm$^{-1}$ is calculated. (Pc1)

(7) The average value of absorption intensity at 3050 cm$^{-1}$ and 2600 cm$^{-1}$ is calculated. (Pc2)

(8) Pc1−Pc2=Pc. The abovementioned Pc is defined as the intensity of the highest absorption peak in the range from 2843 cm$^{-1}$ to 2853 cm$^{-1}$.

(9) A maximum value of absorption peak intensity in the range from 1713 cm$^{-1}$ to 1723 cm$^{-1}$ is calculated. (Pd1)

(10) The average value of absorption intensity at 1763 cm$^{-1}$ and 1630 cm$^{-1}$ is calculated. (Pd2)

(11) Pd1−Pd2=Pd. The abovementioned Pd is defined as the intensity of the highest absorption peak in the range from 1713 cm$^{-1}$ to 1723 cm$^{-1}$.

(12) Pc/Pd=P2.

[Calculation Method of P1/P2]

Herein, P1/P2 is calculated using P1 and P2 determined as described above.

<Method for Measuring Toner Average Circularity and Number % of Small Particles>

The average circularity of the toner and number % of small particles in the toner is measured with a flow-type particle image analyzer "FPIA-3000" (by Sysmex Corporation) under measurement and analysis conditions as at the time of calibration.

The measurement principle of the flow-type particle image analyzer "FPIA-3000" (by Sysmex Corporation) involves capturing static images of flowing particles, and analyzing the images. A sample added to a sample chamber is transferred to a flat-sheath flow cell by way of a sample suction syringe. The sample fed into the flat-sheath flow forms flat flow by being sandwiched between sheath liquids. The sample passing through the flat-sheath flow cell is irradiated with stroboscopic light at an interval of 1/60th of a second. Thereby, images of the flowing particles can thus be captured as static images. The particles are captured in a focused state, since the flow is flat. The particle image is captured by a CCD camera, and the captured image is subjected to image processing at an image processing resolution of 512×512 pixels (0.37 μm×0.37 μm per pixel). The outline of each particle image is extracted, and there are measured a projected area S, perimeter L and so forth of each particle image.

The circle-equivalent diameter and circularity are worked out using the abovementioned area S and perimeter L. The circle-equivalent diameter is defined as the diameter of a circle having the same area as that of the projected area of a particle image; and the circularity C is defined as a value obtained by dividing the perimeter of a circle worked out on the basis of the circle-equivalent diameter by the perimeter of a particle projection image. The circularity is calculated based on the following equation $$\text{Circularity } C=2\times(\pi\times S)^{1/2}/L.$$

The circularity of a perfectly round particle image is 1.000. The larger the degree of irregularity of the periphery of a particle image, the smaller the value of circularity of the particle in the image. After calculation of the circularity of each particle, an average circularity value is obtained by dividing a circularity range of 0.200 to 1.000 into 800 sections and by calculating the arithmetic mean value of the obtained circularities.

The specific measurement method is as follows. First, about 20 ml of deionized water from which solid impurities and the like have been removed beforehand are charged into a container made of glass. Then, about 0.2 ml of a diluted solution prepared by diluting "Contaminon N" (a 10-mass % aqueous solution of a neutral detergent for washing precision instruments, comprising a nonionic surfactant, a anionic surfactant, and an organic builder, and having a pH of 7, by Wako Pure Chemical Industries, Ltd.) with about three times its mass of deionized water, is added, as a dispersant, to the container. Further, about 0.02 g of a measurement sample is added to the container, and the mixture is subjected to a dispersion treatment using an ultrasonic dispersing unit for 2 minutes, to yield a dispersion for measurement. The dispersion is appropriately cooled to a temperature ranging from 10° C. to 40° C. A desktop ultrasonic cleaning and dispersing unit having an oscillation frequency of 50 kHz and an electrical output of 150 W (such as a "VS-150" (by Velvo-Clear)) is used as the ultrasonic dispersing unit. A predetermined amount of deionized water is charged into a water tank, and about 2 ml of Contaminon N are added to the water tank.

The flow-type particle image analyzer equipped with a standard objective lens (10×) is used in the measurement, and a particle sheath "PSE-900A" (by Sysmex Corporation) is used as the sheath liquid. The dispersion prepared in accordance with the above procedure is introduced into the flow-type particle image analyzer, and the particle sizes of 3,000 toner particles are measured according to a total count mode in an HPF measurement mode. By setting the binarization threshold value during particle analysis to 85% and specifying the analyzed particle diameter, the number % and average circularity of particles in this range can be calculated. The proportion of particles (small particles) having an circle-equivalent diameter ranging from 0.50 μm to less than 1.98 μm is calculated as the number proportion (%) of particles ranging from 0.50 μm to less than 1.98 μm with respect to all particles having a circle-equivalent diameter ranging from 0.50 μm to less than 39.69 μm, taking the range from 0.50 μm to less than 1.98 μm as the analysis particle size range of circle-equivalent diameter. The average circularity of the toner is worked out for a circle-equivalent diameter ranging from 1.98 μm to less than 39.69 μm.

Prior to start of measurements, automatic focusing is performed by using standard latex particles (obtained by diluting, for example, "RESEARCH AND TEST PARTICLES Latex Microsphere Suspensions 5200A" by Duke Scientific with deionized water). Thereafter, focus adjustment is preferably performed every two hours from measurement start.

In the examples of the present application there is used the flow-type particle image analyzer calibrated by Sysmex Corporation, and granted with a calibration certificate issued by Sysmex Corporation. Measurement is performed under measurement and analysis conditions identical to those at the time of granting of the calibration certificate, except that herein particle sizes to be analyzed are limited to those corresponding to a circle-equivalent diameter ranging from 0.50 μm to less than 1.98 μm, or from 1.98 μm to less than 39.69 μm.

<Method for Measuring the Peak Molecular Weight (Mp), Number Average Molecular Weight (Mn), and Weight-Average Molecular Weight (Mw) of the Resin>

The peak molecular weight (Mp), the number average molecular weight (Mn) and the weight-average molecular weight (Mw) are measured as follows by gel permeation chromatography (GPC).

Firstly, a sample (resin) is dissolved in tetrahydrofuran (THF) over 24 hours at room temperature. The obtained solution is filtered using a solvent-resistant membrane filter "Maeshori (Pretreatment) Disk" (by Tosoh Corporation) having a pore size of 0.2 μm, to yield a sample solution. The sample solution is adjusted to yield a concentration of THF-soluble component of about 0.8 mass %. The sample solution is measured under the following conditions.

Apparatus: HLC 8120 GPC (detector: RI) (by Tosoh Corporation)

Column: seven-stage Shodex KF-801, 802, 803, 804, 805, 806, and 807 (by Showa Denko K. K.)

Eluent: tetrahydrofuran (THF)

Flow rate: 1.0 ml/min

Oven temperature: 40.0° C.

Sample injection volume: 0.10 ml

To calculate the molecular weight of the sample there is used a molecular weight calibration curve obtained using a standard polystyrene resin (for instance, product name: "TSK standard polystyrene F-850, F-450, F-288, F-128, F-80, F-40, F-20, F-10, F-4, F-2, F-1, A-5000, A-2500, A-1000, A-500", by Tosoh Corporation).

<Method for Measuring the Softening Point of the Resin>

The softening point of the resin is measured with a constant-load extruding capillary rheometer "Flow characteristic evaluating device Flow Tester CFT-500D" (by Shimadzu Corporation) in accordance with the manual included with the device. In this device, the temperature of a measurement sample that fills a cylinder is raised, to melt the measurement sample, while a constant load is applied by a piston from above the measurement sample. The melted measurement sample is extruded from a die at the bottom of the cylinder, and there is obtained a flow curve that denotes the relationship between temperature and the degree of piston descent.

In the present application, the softening point is the "½-basis melting temperature" in the manual included with the "flow characteristic evaluating apparatus Flow Tester CFT-500D". The "½-basis melting temperature" is calculated as follows. There is worked out the half of the difference (notated as X) between the amount of descent of the piston at the point in time at which outflow stops, Smax, and the amount of descent of the piston at the point in time at which outflow starts, 5 min (that is, X=(Smax−Smin)/2). The temperature in the flow curve at the time where the amount of descent of the piston is X in the flow curve is the ½-basis melting temperature.

The measurement sample used is shaped as a solid cylinder about 8 mm in diameter resulting from compression-molding about 1.0 g of resin using a tablet molding compressor (for instance, NT-100H by NPA SYSTEM Co., Ltd.), in an environment at 25° C., at about 10 MPa, for about 60 seconds.

The CFT-500D measurement conditions were as follows.

Test mode: temperature rise method

Starting temperature: 50° C.

Saturated temperature: 200° C.

Measurement interval: 1.0° C.

Temperature rise rate: 4.0° C./min

Piston sectional area: 1.000 $cm^2$

Test load (piston load): 10.0 kgf (0.9807 MPa)

Preheating time: 300 seconds

Die hole diameter: 1.0 mm

Die length: 1.0 mm

<Measurement of the Highest Endothermic Peak of the Wax>

The peak temperature of the highest endothermic peak of the wax is measured using a differential scanning calorimeter "Q1000" (by TA Instruments Japan Ltd.) according to ASTM D3418-82. The temperature of the detection unit of the device is corrected on the basis of the melting point of indium and zinc, and the amount of heat is corrected on the basis of the heat of fusion of the indium.

Specifically, about 10 mg of wax is accurately weighed out and placed in an aluminum pan, and a measurement is performed at a temperature rise rate of 10° C./min over a measurement temperature range from 30° C. to 200° C., using an aluminum pan in air as a reference. In the measurement, the temperature is raised once up to 200° C., is then lowered to 30° C., and is raised again. The temperature that denotes the highest endothermic peak in the temperature range from 30° C. to 200° C. of the DSC curve in this second temperature rise process is taken as the peak temperature of the highest endothermic peak (melting point) of the wax.

<Measurement of the BET Specific Surface Area of the Inorganic Fine Particles>

The BET specific surface area of the inorganic fine particles is measured according to JIS 28830 (2001). The specific measurement method is as follows.

The measurement device used is an "automatic specific surface area/pore distribution measuring instrument TriStar 3000" (by Shimadzu Corporation), the measurement scheme of which is a gas adsorption method according to a constant-volume method. Setting of measurement conditions and analysis of measurement data are performed using the software "TriStar 3000 Version 4.00" included with the instrument. A vacuum pump, a nitrogen gas feed pipe and a helium gas feed pipe are also connected to the instrument. Nitrogen gas is used as the adsorption gas, and the value calculated by the BET multi-point method is taken as the BET specific surface area of the inorganic fine particles.

The BET specific surface area is calculated as follows.

First, the inorganic fine particles are caused to adsorb nitrogen gas, and there are measured an equilibrium pressure P (Pa) in a sample cell and a nitrogen adsorption amount Va ($mol \cdot g^{-1}$) at that time. Then, an adsorption isotherm is obtained in which the abscissa axis represents relative pressure Pr as a value obtained by dividing the equilibrium pressure P (Pa) in the sample cell by a saturated vapor pressure Po (Pa) of nitrogen, and the ordinate axis represents the nitrogen adsorption Va ($mol \cdot g^{-1}$). Next, a monomolecular layer adsorption amount Vm ($mol \cdot g^{-1}$), as the adsorption amount needed for the formation of a monomolecular layer on the surface of the inorganic fine particles, is determined using the BET equation below.

$$Pr/Va(1-Pr)=1/(Vm\times C)+(C-1)\times Pr/(Vm\times C)$$

(where the BET parameter denoted by C is a variable that varies depending on the kind of the measurement sample, the kind of the adsorption gas, and the adsorption temperature).

The BET equation can be interpreted as a straight line having a slope of (C−1)/(Vm×C) and an intercept of 1/(Vm×C), where the X-axis represents Pr and the Y-axis represents Pr/Va(1−Pr) (the straight line is referred to as "BET plot").

$$\text{Slope of straight line}=(C-1)/(Vm\times C)$$

$$\text{Straight line intercept}=1/(Vm\times C)$$

Actual measurement values for Pr and actual measurement values for Pr/Va(1−Pr) are plotted on a graph, and a straight line is drawn by a least-square method. This allows calculating the straight line slope and intercept value. Herein, Vm and C can be calculated by solving the above simultaneous equations for the slope and the intercept, using the above values.

Further, a BET specific surface area S ($m^2/g$) of the inorganic fine particles is calculated from the calculated Vm and the molecule-occupied sectional area (0.162 $nm^2$) of nitrogen molecules, on the basis of the following equation $S=Vm\times N\times 0.162\times 10^{18}$ (where N represents Avogadro's number ($mol^{-1}$)).

Measurements using the device are performed in conformity with "TriStar3000 Instruction Manual V4.0" included with the device, according to the following procedure.

The tare weight of a dedicated sample cell made of glass (having a stem diameter of ⅜ inch and a volume of about 5 ml) that has been thoroughly washed and dried is precisely weighed. Then, about 0.1 g of the inorganic fine particles is loaded into the sample cell using a funnel.

The sample cell containing the inorganic fine particles is set in a "pretreatment apparatus VacuPrep 061 (by Shimadzu Corporation)" to which a vacuum pump and nitrogen gas piping are connected, whereupon vacuum degassing is continued at 23° C. for about 10 hours. Vacuum degassing is gradually performed while a valve is adjusted in such a manner that the inorganic fine particles are not sucked by the vacuum pump. Pressure in the cell gradually drops accompanying degassing, to reach eventually about 0.4 Pa (about 3 mTorr). Once vacuum degassing is over, nitrogen gas is gradually injected to return the pressure in the sample cell to atmospheric pressure, and then the sample cell is removed from the pretreatment apparatus. The mass of the sample cell is precisely weighed, and the accurate mass of the inorganic fine particles is calculated on the basis of the difference between the tare weight and the mass. The sample cell is capped with a rubber stopper during the weighing in such a way so as prevent the inorganic fine particles in the sample cell from being contaminated with, for example, moisture in air.

Next, a dedicated "isothermal jacket" is attached to a stem portion of the sample cell containing the inorganic fine particles. A dedicated filler rod is inserted into the sample cell, and the sample cell is set in an analysis port of the apparatus. The isothermal jacket is a tubular member having an inner surface of a porous material and an outer surface of an impervious material, such that the isothermal jacket is capable of suctioning up liquid nitrogen to a given level by capillarity.

The free space of the sample cell including a connection fixture is measured next. The volume of the sample cell is measured using helium gas at 23° C. The volume of the sample cell is measured next, using likewise helium gas, after cooling of the sample cell in liquid nitrogen. The free space is calculated then based on the difference between the foregoing volumes. The saturated vapor pressure Po (Pa) of nitrogen is measured automatically, separately, using a Po tube that is built into the apparatus.

Next, the interior of the sample cell is vacuum-degassed, and the sample cell is cooled in liquid nitrogen while vacuum degassing is continued. Thereafter, nitrogen gas is introduced into the sample cell in a stepwise manner so that the nitrogen molecules are caused to become adsorbed onto the inorganic fine particles. Herein, the adsorption isotherm can be obtained by measuring the equilibrium pressure P (Pa) at an arbitrary time. The adsorption isotherm is therefore converted to a BET plot. Points of relative pressure Pr at which data are collected are set to a total of six points, namely 0.05, 0.10, 0.15, 0.20, 0.25 and 0.30. A straight line is drawn for the obtained measurement data by a least-square method, and Vm is calculated from the slope and intercept of the straight line. The BET specific surface area of the inorganic fine particles is calculated using the value for Vm as described above.

<Method for Measuring the Weight-Average Particle Size (D4) of Toner Particles>

The weight-average particle size (D4) of toner particles is measured using a precision granularity distribution measuring apparatus that relies on a pore electrical resistance method and is provided with a 100-μm aperture tube "Coulter Counter Multisizer 3" (registered trademark, by Beckman Coulter, Inc.), as a measuring apparatus. Setting of measurement conditions and the analysis of measurement data is performed using a dedicated software "Beckman Coulter Multisizer 3 Version 3.51" (by Beckman Coulter, Inc.) included with the apparatus. Measurement is performed with the number of effective measurement channels set to 25,000. Measurement data is analyzed and subjected to calculations.

An electrolytic aqueous solution prepared by dissolving reagent grade sodium chloride in deionized water to a concentration of about 1 mass %, for example, "ISOTON II" (by Beckman Coulter, Inc.) can be used in the measurement.

The abovementioned dedicated software is set, as described below, prior to measurement and analysis.

In the "change of standard measurement method (SOM)" screen of the dedicated software, the total count number of a control mode is set to 50,000 particles, the number of measurements is set to 1, and a value obtained by using "standard particles 10.0 μm" (by Beckman Coulter, Inc.) is set as a Kd value. A threshold value and a noise level are automatically set by pressing a "threshold/noise level measurement" button. Current is set to 1600 μA, gain is set to 2, electrolyte solution is set to ISOTON II, and a check box for "flush aperture tube after measurement" is ticked.

In the "setting screen for conversion from pulse to particle size" of the dedicated software, a bin interval is set to a logarithmic particle size, the number of particle size bins is set to 256, and a particle size range is set to range from 2 μm to 60 μm.

A specific measurement method is as described below.

(1) About 200 ml of the electrolytic aqueous solution are charged into a 250-ml round-bottom beaker, made of glass, dedicated for the Multisizer 3. The beaker is set in a sample stand, and the electrolyte solution in the beaker is stirred with a stirrer rod at 24 revolutions/sec in a counterclockwise direction. Then, dirt and bubbles in the aperture tube are removed by virtue of the "aperture flush" function of the dedicated software.

(2) About 30 ml of the electrolytic aqueous solution are charged into a 100-ml flat-bottom beaker made of glass. Then, about 0.3 ml of a diluted solution prepared by diluting "Contaminon N" (a 10-mass % aqueous solution of a neutral detergent for washing precision instruments, comprising a nonionic surfactant, a anionic surfactant, and an organic builder, and having a pH of 7, by Wako Pure Chemical Industries, Ltd.) with three times its mass of deionized water, is added, as a dispersant, to the beaker.

(3) A predetermined amount of deionized water is charged into the water tank of an ultrasonic dispersing unit "Ultrasonic Dispersion System Tetra 150" (by Nikkaki Bios Co., Ltd.), having built thereinto two oscillators of oscillation frequency of 50 kHz, being out of phase by 180° with respect to each other, and having an electrical output of 120 W. About 2 ml of Contaminon N is then added to the water tank.

(4) The beaker in (2) is set in a beaker fixing hole of the ultrasonic dispersing unit, and the ultrasonic dispersing unit is operated. Then, the height position of the beaker is adjusted in such a manner that the resonance state of the liquid level of the electrolytic aqueous solution in the beaker is maximal.

(5) About 10 mg of toner are gradually added to, and dispersed in, the electrolytic aqueous solution in the beaker of (4) in a state where the electrolytic aqueous solution is being irradiated with ultrasounds. The ultrasonic dispersion treatment is continued for an additional 60 seconds. The temperature of water in the water tank is appropriately adjusted so as to range from 10° C. to 40° C. upon ultrasonic dispersion.

(6) The electrolytic aqueous solution in (5) having the toner dispersed therein is dripped, using a pipette, onto the round-bottom beaker in (1) placed in the sample stand, and the concentration of the toner to be measured is adjusted to about 5%. Measurement is performed until 50,000 particles are measured.

(7) The measurement data is analyzed with the dedicated software included with the apparatus, to calculate the weight-average particle size (D4). Herein, the weight-average particle size (D4) is the "average diameter" on the screen analysis/volume statistics (arithmetic average) of the dedicated software, upon setting to graph/vol %.

EXAMPLES

Specific examples of the present invention are explained below. In the blends below, "parts" and "%" denote parts and % by mass, unless otherwise specified.

Binder Resin Production Example 1

Herein, 76.9 parts by mass (0.167 moles) of polyoxypropylene(2.2)-2,2-bis(4-hydroxyphenyl)propane, 24.1 parts by mass (0.145 moles) of terephthalic acid and 0.5 parts by mass of titanium tetrabutoxide were charged in a 4-L four-necked flask made of glass. The flask was equipped with a thermometer, a stirring rod, a condenser, and a nitrogen-introducing pipe, and was placed in a mantle heater. Next, air in the flask was replaced with nitrogen gas, and then the temperature in the flask was gradually raised, under stirring. The reaction was left to proceed for 4 hours while under stirring at 200° C. (first reaction step). Thereafter, 2.0 parts by mass (0.010 moles) of trimellitic anhydride were added, and the reaction was left to proceed for 1 hour at 180° C. (second reaction step), to yield a binder resin 1.

The acid value of the binder resin 1 was 10 mgKOH/g, and the hydroxyl value was 65 mgKOH/g. The GPC molecular weights were weight-average molecular weight (Mw) 8,000, number average molecular weight (Mn) 3,500 and peak molecular weight (Mp) 5,700. The softening point was 90° C.

Binder Resin Production Example 2

Herein, 71.3 parts by mass (0.155 moles) of polyoxypropylene(2.2)-2,2-bis(4-hydroxyphenyl)propane, 24.1 parts by mass (0.145 moles) of terephthalic acid and 0.6 parts by mass of titanium tetrabutoxide were charged in a 4-L four-necked flask made of glass. The flask was equipped with a thermometer, a stirring rod, a condenser, and a nitrogen-introducing pipe, and was placed in a mantle heater. Next, air in the flask was replaced with nitrogen gas, and then the temperature in the flask was gradually raised, under stirring. The reaction was left to proceed for 2 hours while under stirring at 200° C. (first reaction step). Thereafter, 5.8 parts by mass (0.030 mole %) of trimellitic anhydride were added, and the reaction was left to proceed for 10 hours at 180° C. (second reaction step), to yield a binder resin 2.

The acid value of the binder resin 2 was 15 mgKOH/g, the hydroxyl value was 7 mgKOH/g. The GPC molecular weights were weight-average molecular weight (Mw) 200,000, number average molecular weight (Mn) 5,000 and peak molecular weight (Mp) 10,000. The softening point was 130° C.

Toner Production Example 1

Binder resin 1: 50 parts by mass
Binder resin 2: 50 parts by mass
Fischer-Tropsch wax (peak temperature of highest endothermic peak: 78° C.): 5 parts by mass
C.I. Pigment Blue 15:3: 5 parts by mass
Aluminum compound of 3,5-di-t-butylsalicylic acid: 0.5 parts by mass
Hydrophobic silica fine particles: 0.6 parts by mass
(Silica fine particles having a BET specific surface area of 25 $m^2/g$ and subjected to surface treatment with 4.0 mass % of hexamethyldisilazane)

The abovementioned materials were mixed in a Henschel mixer (FM-75 model, by Mitsui Mining Co., Ltd.), at revolutions of 20 $s^{-2}$ and a rotation time of 5 minutes, and the resulting mixture was kneaded in a biaxial kneader (PCM-30 model, by Ikegai, Ltd.) at a temperature set to 120° C. The obtained kneaded product was cooled, and was coarsely pulverized to a size of 1 mm or less with a hammer mill, whereby a coarsely pulverized product was obtained. The obtained coarsely pulverized product was pulverized with a mechanical type pulverizer (T-250, by Turbo Kogyo Co., Ltd.). The product was sorted by using a rotary sorting machine (200TSP, by Hosokawa Micron Corporation), to yield colored particles 1. Sorting rotor revolutions of 50.0 $s^{-2}$ were set as the operating conditions of the sorting machine (200TSP by Hosokawa Micron Corporation). The weight-average particle size (D4) of the obtained colored particles 1 was 5.8 μm. To 100 parts by mass of the obtained colored particles 1 there were added 3.0 parts by mass of hydrophobic silica fine particles having a BET specific surface area of 25 $m^2/g$ and having been subjected to a surface treatment with 4 mass % of hexamethyldisilazane, and 0.2 parts by mass of titanium oxide fine particles having a BET specific surface area of 180 $m^2/g$ and subjected to a surface treatment with 16 mass % of isobutyltrimethoxysilane. The whole was mixed in a Henschel mixer (FM-75 Model, by Mitsui Mining Co., Ltd.), at revolutions 30 $s^{-2}$ and rotation time 10 minutes. The colored particles were subjected to a thermal treatment in the surface treatment apparatus illustrated in FIG. 1. The operating conditions included a feed rate=5 kg/hr, hot air temperature C=240° C. and hot air flow rate=6 $m^3$/min, cold air temperature E=5° C., cold air flow rate=4 $m^3$/min, cold air absolute moisture content=3 $g/m^3$, blower airflow=20 $m^3$/min, injection air flow rate=1 $m^2$/min. The obtained treated toner particles 1 had an average circularity of 0.965 and a weight-average particle size (D4) of 6.2 μm.

To 100 parts by mass of the obtained treated toner particles 1 there were added 1.0 part by mass of hydrophobic silica fine particles having a BET specific surface area of 25 $m^2/g$ and having been subjected to a surface treatment with 4 mass % of hexamethyldisilazane, and 0.5 parts by mass of strontium titanate fine particles having a BET specific surface area of 10 $m^2/g$ and subjected to a surface treatment with 10 mass % of isobutyltrimethoxysilane. The whole was mixed in a Henschel mixer (FM-75 Model, by Mitsui Miike Engineering Corporation), at revolutions 30 $s^{-2}$ and rotation time 20 minutes, to yield a toner 1. The properties of the toner 1 are given in Table 2.

Toner Production Examples 2 to 35

Toners 2 to 35 were manufactured in the same way as in the toner production example 1, but modifying the toner formulations and production conditions as given in Table 1-1 and Table 1-2. The properties of toners 2 to 35 are given in Table 2.

TABLE 1-1

| | Fixed through hot air Inorganic fine particles | | Contained beforehand in toner particles Fine particles | | | |
|---|---|---|---|---|---|---|
| | Type/specific surface area ($m^2/g$)/parts | Type/specific surface area ($m^2/g$)/parts | Type/specific surface area ($m^2/g$)/parts | Wax | | |
| | | | | Composition | Melting point | Parts |
| Toner 1 | Silica fine particles/25/3.0 parts | Titanium oxide fine particles/180/0.2 parts | Silica fine particles/25/0.6 parts | Hydrocarbon-based (1) | 78° C. | 5 parts |
| Toner 2 | ↑ | ↑ | ↑ | ↑ | ↑ | ↑ |
| Toner 3 | ↑ | ↑ | ↑ | ↑ | ↑ | ↑ |
| Toner 4 | ↑ | ↑ | ↑ | ↑ | ↑ | ↑ |
| Toner 5 | ↑ | ↑ | ↑ | ↑ | ↑ | ↑ |
| Toner 6 | Silica fine particles/25/6.0 parts | ↑ | ↑ | ↑ | ↑ | ↑ |
| Toner 7 | Silica fine particles/25/1.5 parts | ↑ | ↑ | ↑ | ↑ | ↑ |

TABLE 1-1-continued

| | | | | | | |
|---|---|---|---|---|---|---|
| Toner 8 | Silica fine particles/ 25/0.3 parts | ↑ | ↑ | ↑ | ↑ | ↑ |
| Toner 9 | ↑ | ↑ | ↑ | ↑ | ↑ | ↑ |
| Toner 10 | ↑ | ↑ | — | ↑ | ↑ | ↑ |
| Toner 11 | Silica fine particles/ 25/1.5 parts | — | Silica fine particles/ 25/0.3 parts | ↑ | ↑ | ↑ |
| Toner 12 | Titanium oxide fine particles/180/1.5 parts | — | Titanium oxide fine particles/180/0.3 parts | ↑ | ↑ | ↑ |
| Toner 13 | Titanium oxide fine particles/75/1.5 | — | Titanium oxide fine particles/75/0.3 | ↑ | ↑ | ↑ |
| Toner 14 | Silica fine particles/ 85/1.5 parts | — | Silica fine particles/ 85/0.3 parts | ↑ | ↑ | ↑ |
| Toner 15 | Silica fine particles/ 17/1.5 parts | — | Silica fine particles/ 17/0.3 parts | ↑ | ↑ | ↑ |
| Toner 16 | Silica fine particles/ 12/1.5 parts | — | Silica fine particles/ 12/0.3 parts | ↑ | ↑ | ↑ |
| Toner 17 | Silica fine particles/ 8/1.5 parts | — | Silica fine particles/ 8/0.3 parts | ↑ | ↑ | ↑ |

| | External additive 1 Type/specific | External additive 2 Type/specific | Sorting conditions Sorting | Thermal treatment conditions | |
|---|---|---|---|---|---|
| | surface area ($m^2/g$)/parts | surface area ($m^2/g$)/parts | rotor revolutions | Hot air temperature | Absolute moisture content of cold air |
| Toner 1 | Silica fine particles/ 25/1.0 parts | Strontium titanate/ 10/0.5 parts | 50.0 $s^{-1}$ | 240° C. | 3 g |
| Toner 2 | ↑ | ↑ | 45.0 $s^{-1}$ | ↑ | ↑ |
| Toner 3 | ↑ | ↑ | 40.0 $s^{-1}$ | ↑ | ↑ |
| Toner 4 | ↑ | ↑ | 35.0 $s^{-1}$ | ↑ | ↑ |
| Toner 5 | ↑ | ↑ | 27.0 $s^{-1}$ | ↑ | ↑ |
| Toner 6 | ↑ | ↑ | ↑ | ↑ | ↑ |
| Toner 7 | ↑ | ↑ | ↑ | ↑ | ↑ |
| Toner 8 | ↑ | ↑ | ↑ | ↑ | ↑ |
| Toner 9 | — | — | ↑ | ↑ | ↑ |
| Toner 10 | Silica fine particles/ 25/1.0 parts | Strontium titanate/ 10/0.5 parts | ↑ | ↑ | ↑ |
| Toner 11 | ↑ | ↑ | ↑ | ↑ | ↑ |
| Toner 12 | ↑ | ↑ | ↑ | ↑ | ↑ |
| Toner 13 | ↑ | ↑ | ↑ | ↑ | ↑ |
| Toner 14 | ↑ | ↑ | ↑ | ↑ | ↑ |
| Toner 15 | ↑ | ↑ | ↑ | ↑ | ↑ |
| Toner 16 | ↑ | ↑ | ↑ | ↑ | ↑ |
| Toner 17 | ↑ | ↑ | ↑ | ↑ | ↑ |

TABLE 1-2

| | Fixed through hot air Inorganic fine particles | | Contained beforehand in toner particles Fine particles | | | |
|---|---|---|---|---|---|---|
| | Type/specific | Type/specific | Type/specific | Wax | | |
| | surface area ($m^2/g$)/parts | surface area ($m^2/g$)/parts | surface area ($m^2/g$)/parts | Composition | Melting point | Parts |
| Toner 18 | Silica fine particles/ 25/1.5 parts | — | Silica fine particles/ 25/0.3 parts | Hydrocarbon-based (2) | 58° C. | 5 parts |
| Toner 19 | ↑ | — | ↑ | ↑ (3) | 66° C. | ↑ |
| Toner 20 | ↑ | — | ↑ | ↑ (4) | 90° C. | ↑ |
| Toner 21 | ↑ | — | ↑ | ↑ (5) | 105° C. | ↑ |
| Toner 22 | ↑ | — | ↑ | Hydrocarbon-based (1) + ester-based (6) | 78° C. + 84° C. | 3 parts + 2 parts |
| Toner 23 | ↑ | — | ↑ | Ester-based (6) | 84° C. | 5 parts |
| Toner 24 | ↑ | — | ↑ | Hydrocarbon-based (7) | 47° C. | ↑ |

TABLE 1-2-continued

| | | | | | | |
|---|---|---|---|---|---|---|
| Toner 25 | ↑ | — | ↑ | ↑ (8) | 130° C. | ↑ |
| Toner 26 | ↑ | — | ↑ | ↑ (1) | 78° C. | ↑ |
| Toner 27 | ↑ | — | ↑ | ↑ | ↑ | ↑ |
| Toner 28 | — | — | Silica fine particles/ 25/0.6 parts | ↑ | ↑ | ↑ |
| Toner 29 | — | — | — | ↑ | ↑ | ↑ |
| Toner 30 | Silica fine particles/ 25/3.0 Parts | Titanium oxide fine particles/ 180/0.2 parts | Silica fine particles/ 25/0.6 parts | ↑ | ↑ | ↑ |
| Toner 31 | Silica fine particles/ 15/2.5 Parts | Silica fine particles/ 225/1.0 Parts | — | ↑ | ↑ | 3 parts |
| Toner 32 | — | — | Silica fine particles/ 25/0.6 parts | ↑ | ↑ | 5 parts |
| Toner 33 | Silica fine particles/ 25/0.3 parts | Titanium oxide fine particles/ 150/0.2 parts | ↑ | ↑ | ↑ | ↑ |
| Toner 34 | ↑ | Titanium oxide fine particles/ 100/0.3 parts | ↑ | ↑ | ↑ | ↑ |
| Toner 35 | ↑ | Titanium oxide fine particles/ 90/0.4 parts | ↑ | ↑ | ↑ | ↑ |

| | External additive 1 Type/specific surface area ($m^2$/g)/parts | External additive 2 Type/specific surface area ($m^2$/g)/parts | Sorting conditions Sorting rotor revolutions | Thermal treatment conditions Hot air temperature | Absolute moisture content of cold air |
|---|---|---|---|---|---|
| Toner 18 | Silica fine particles/ 25/1.0 parts | Strontium titanate/ 10/0.5 parts | 27.0 $s^{-1}$ | 240° C. | 3 g |
| Toner 19 | ↑ | ↑ | ↑ | ↑ | ↑ |
| Toner 20 | ↑ | ↑ | ↑ | ↑ | ↑ |
| Toner 21 | ↑ | ↑ | ↑ | ↑ | ↑ |
| Toner 22 | ↑ | ↑ | ↑ | ↑ | ↑ |
| Toner 23 | ↑ | ↑ | ↑ | ↑ | ↑ |
| Toner 24 | ↑ | ↑ | ↑ | ↑ | ↑ |
| Toner 25 | ↑ | ↑ | ↑ | ↑ | ↑ |
| Toner 26 | ↑ | ↑ | ↑ | 280° C. | ↑ |
| Toner 27 | ↑ | ↑ | ↑ | 240° C. | 7 g |
| Toner 28 | ↑ | ↑ | 50.0 $s^{-1}$ | — | — |
| Toner 29 | ↑ | ↑ | ↑ | 240° C. | 7 g |
| Toner 30 | ↑ | ↑ | ↑ | ↑ | 10 g |
| Toner 31 | Titanium oxide fine particles/ 20/0.5 parts | — | Airflow-type sorting | 300° C. | 10 g |
| Toner 32 | Silica fine particles/ 25/1.0 Parts | Strontium titanate/ 10/0.5 parts | 27.0 $s^{-1}$ | 240° C. | 3 g |
| Toner 33 | ↑ | ↑ | ↑ | ↑ | ↑ |
| Toner 34 | ↑ | ↑ | ↑ | ↑ | ↑ |
| Toner 35 | ↑ | ↑ | ↑ | ↑ | ↑ |

In the Table 1-1 and Table 1-2, (1) denotes a Fischer-Tropsch wax, (2) denotes a Paraffin wax, (3) denotes a Paraffin wax, (4) denotes a Fischer-Tropsch wax, (5) denotes a Fischer-Tropsch wax, (6) denotes a behenyl behenate wax, (7) denotes a Paraffin wax, (8) denotes a polyethylene wax.

TABLE 2

| | P1 | P2 | P1/P2 | Average circularity | Number proportion of particles from 0.50 μm to less than 1.98 μm number % |
|---|---|---|---|---|---|
| Toner 1 | 0.45 | 0.30 | 1.50 | 0.965 | 4 number % |
| Toner 2 | 0.45 | 0.30 | 1.50 | 0.965 | 7 number % |
| Toner 3 | 0.45 | 0.30 | 1.50 | 0.965 | 12 number % |
| Toner 4 | 0.45 | 0.30 | 1.50 | 0.965 | 14 number % |
| Toner 5 | 0.45 | 0.30 | 1.50 | 0.965 | 20 number % |
| Toner 6 | 0.38 | 0.30 | 1.27 | 0.965 | 20 number % |
| Toner 7 | 0.48 | 0.30 | 1.60 | 0.965 | 20 number % |
| Toner 8 | 0.55 | 0.30 | 1.83 | 0.965 | 20 number % |
| Toner 9 | 0.55 | 0.30 | 1.83 | 0.965 | 20 number % |

TABLE 2-continued

| | P1 | P2 | P1/P2 | Average circularity | Number proportion of particles from 0.50 μm to less than 1.98 μm number % |
|---|---|---|---|---|---|
| Toner 10 | 0.58 | 0.30 | 1.93 | 0.965 | 20 number % |
| Toner 11 | 0.48 | 0.30 | 1.60 | 0.965 | 20 number % |
| Toner 12 | 0.38 | 0.30 | 1.27 | 0.965 | 20 number % |
| Toner 13 | 0.40 | 0.30 | 1.33 | 0.965 | 20 number % |
| Toner 14 | 0.38 | 0.30 | 1.27 | 0.965 | 20 number % |
| Toner 15 | 0.52 | 0.30 | 1.73 | 0.965 | 20 number % |
| Toner 16 | 0.55 | 0.30 | 1.83 | 0.965 | 20 number % |
| Toner 17 | 0.58 | 0.30 | 1.93 | 0.965 | 20 number % |
| Toner 18 | 0.52 | 0.30 | 1.73 | 0.965 | 20 number % |
| Toner 19 | 0.50 | 0.30 | 1.67 | 0.965 | 20 number % |
| Toner 20 | 0.46 | 0.30 | 1.53 | 0.965 | 20 number % |
| Toner 21 | 0.44 | 0.30 | 1.47 | 0.965 | 20 number % |
| Toner 22 | 0.46 | 0.30 | 1.53 | 0.965 | 20 number % |
| Toner 23 | 0.45 | 0.30 | 1.50 | 0.965 | 20 number % |
| Toner 24 | 0.54 | 0.30 | 1.80 | 0.965 | 20 number % |
| Toner 25 | 0.37 | 0.30 | 1.23 | 0.965 | 20 number % |

TABLE 2-continued

| | P1 | P2 | P1/P2 | Average circularity | Number proportion of particles from 0.50 μm to less than 1.98 μm number % |
|---|---|---|---|---|---|
| Toner 26 | 0.48 | 0.30 | 1.95 | 0.978 | 20 number % |
| Toner 27 | 0.59 | 0.30 | 1.97 | 0.965 | 20 number % |
| Toner 28 | 0.30 | 0.30 | 1.00 | 0.940 | 4 number % |
| Toner 29 | 0.65 | 0.30 | 2.17 | 0.965 | 4 number % |
| Toner 30 | 0.62 | 0.30 | 2.07 | 0.965 | 4 number % |
| Toner 31 | 0.21 | 0.18 | 1.17 | 0.960 | 49 number % |
| Toner 32 | 0.28 | 0.18 | 1.56 | 0.960 | 20 number % |
| Toner 33 | 0.55 | 0.30 | 1.83 | 0.965 | 20 number % |
| Toner 34 | 0.55 | 0.30 | 1.83 | 0.965 | 20 number % |
| Toner 35 | 0.55 | 0.30 | 1.83 | 0.965 | 20 number % |

Magnetic Core Particles

Production Example 1

Step 1:

$Fe_2O_3$: 71.0 mass %

CuO: 12.5 mass %

ZnO: 16.5 mass %

Ferrite starting materials were weighed in the abovementioned composition ratios. The ferrite starting materials were mixed and pulverized in a ball mill.

Step 2:

The pulverized-mixed ferrite starting material was fired in the atmosphere at a temperature of 950° C. for 2 hours, to prepare a calcined ferrite. The composition of the calcined ferrite was as follows.

$$(CuO)_{0.195}(ZnO)_{0.252}(Fe_2O_3)_{0.553}$$

Step 3:

The calcined ferrite was pulverized to about 0.5 mm, followed by milling for 6 hours in a wet ball mill containing mm-diameter stainless steel balls and water. A ferrite slurry was obtained.

Step 4:

Herein, polyvinyl alcohol was added to the ferrite slurry, in a proportion of 2 parts by mass of polyvinyl alcohol with respect to 100 parts by mass of calcined ferrite. The whole was granulated in a Spray Dryer (by Ohkawara Kakohki Co., Ltd.), to yield spherical particles.

Step 5:

The spherical particles were fired at 1300° C. for 4 hours in the atmosphere.

Step 6:

Aggregated particles were disintegrated, and then coarse particles were removed by screening using a sieve having a sieve opening of 250 μm, to yield magnetic core particles.

Magnetic Carrier Production Example 1

Straight Silicone Resin (Dow Corning Toray SR2411): 20.0 mass %

γ-aminopropyl triethoxysilane: 0.5 mass %

Toluene: 79.5 mass %

The abovementioned material was dispersed and mixed in a bead mill, to yield a resin solution 1.

Then, 100 parts by mass of the magnetic core particles 1 were charged in a Nauta mixer, and the resin solution 1, as the resin component, was further charged into the Nauta mixer to an amount of 2.0 parts by mass. The whole was heated at a temperature of 70° C., under reduced pressure, and was mixed at 100 rpm, for 4 hours, to carry out thereby a solvent removal and coating operations. Thereafter, the obtained sample was transferred to a Julia mixer, and was subjected to a thermal treatment for 2 hours at a temperature of 100° C. in a nitrogen atmosphere. This was followed by sorting using a sieve having a mesh opening of 70 μm, to yield a magnetic carrier 1. The volume-distribution median particle size (D50) of the obtained magnetic carrier 1 was 38.2 μm.

The toner 1 and the magnetic carrier 1 were mixed in a V-type mixer (V-10 by Tokuju Corporation) under conditions 0.5 $s^{-1}$ and rotation time 5 min until the toner concentration reaches 8 mass %, to yield a two-component developer 1.

<Evaluation of Developing Properties>

A converted machine of a full-color copying machine Image Press C7000VP, by Canon Inc., was used as the image-forming apparatus, and the two-component developer 1 was used as a developer.

The evaluation of developing performance was carried out in a normal-temperature normal-humidity environment (23° C., 50% RH), a normal-temperature low-humidity environment (23° C., 5% RH) and a high-temperature high-humidity environment (32.5° C., 80% RH). There was printed a continuous run of 1000 prints of an image having an 80% print ratio on A4 paper sheets. The paper feed direction was laid out horizontally. The development conditions and transfer conditions (without calibration) remained unaltered during printing. The A4 paper used was copy paper CS-814 (A4, basis weight 81.4 g/$m^2$, sold by Canon Marketing Japan Inc.). The image-forming apparatus was adjusted so as to achieve a toner laid-on level of 0.4 mg/$cm^2$ on paper at FFH image portions (solid portions), in each evaluation environment. An FFH image is an FFH (solid) image of 256-th gradation in a scheme where 256 gradation is displayed hexadecimally, such that OOH corresponds to the first gradation (white background).

<Image Density Measurement>

The image density of a solid portion versus that of a white background portion was measured, using an X-Rite color reflective densitometer (500 Series, by X-Rite), for a first image and of a 1000-th image. The difference between the image densities of the first and the 1000-th image was evaluated in accordance with the criteria below.

(Evaluation Criteria)

A: image density difference less than 0.05 (very good)

B: image density difference from 0.05 to less than 0.10 (good)

C: image density difference from 0.10 to less than 0.20 (non-problematic level in the present invention)

D: image density difference of 0.20 or higher (unacceptable level in the present invention)

<Measurement of Fogging in a White Background Portion>

The average reflectance Dr (%) of A4 paper before printing was measured using a reflectometer (REFLECTOMETER MODEL TC-6DS, by Tokyo Denshoku Co., Ltd.)

The reflectance Ds (%) of the white background portion in the above-described first and 1,000-th images was measured. Fogging of the first and 1,000-th images was calculated, using the obtained Dr and Ds, on the basis of the formula below. Fogging (%) of the first and 1,000-th images was evaluated in accordance with the criteria below.

$$\text{Fogging (\%)} = Dr(\%) - Ds(\%)$$

(Evaluation criteria)

A: fogging less than 0.5% (very good)

B: fogging from 0.5% to less than 1.0% (good)

C: fogging from 1.0% to less than 2.0% (non-problematic level in the present invention)

D: fogging of 2.0% or higher (unacceptable level in the present invention)

The evaluation results are given Table 4-1 (normal-temperature normal-humidity environment (23° C., 50% RH)), Table 4-2 (normal-temperature low-humidity environment (23° C., 5% RH)), and Table 4-3 (high-temperature high-humidity environment (32.5° C., 80% RH)).

<Fixability Evaluation>

(Low-Temperature Fixability, Hot-Offset Resistance)

A test on a fixing temperature region was performed by modifying a full-color copying machine imagePress C1+, by Canon Inc., in such a manner that the fixing temperature could be set freely. The abovementioned copying machine was set to a monochrome mode, in a normal-temperature normal-humidity environment (23° C., 50 to 60% RH), and was adjusted so that the toner laid-on level on paper was 1.2 mg/cm$^2$. An unfixed image was prepared having an image print ratio of 25%. The paper used for evaluation was copy paper CS-814 (A4, basis weight 81.4 g/m$^2$, sold by Canon Marketing Japan Inc.). Thereafter, in a normal-temperature normal-humidity environment (23° C., 50 to 60% RH), the fixing temperature was raised sequentially from 100° C. in increments of 5° C., and the unfixed image was fixed at each fixing temperature. The obtained images were rubbed 5 times back and forth using a lens-cleaning paper (DASPER® by Ozu Paper Co. Ltd), under a load of 50 g/cm$^2$. The temperature at which the rate of decrease of image density before and after rubbing was no greater than 5% was set as a low-temperature-side limit temperature, such that low-temperature fixability was evaluated using this temperature. The fixing temperature was raised, and the temperature at which occurrence of offset was noticed was set as a high-temperature-side limit temperature. Hot-offset resistance was evaluated using this temperature.

<Gloss>

The abovementioned unfixed images were fixed, under conditions of low-temperature-side limit temperature +10° C., and the gloss value thereof at a single angle of 60° was measured using a Handy gloss-meter ("PG-1M" by Nippon Denshoku Industries Co., Ltd.).

<Fixation Wrapping Resistance>

As the evaluation machine there was used the abovementioned copying machine. The evaluation paper was GF-500 (A4, basis weight 64.0 g/m$^2$, sold by Canon Marketing Japan Inc.). The paper feed direction was laid out vertically. There were produced 10 sheets of an unfixed image having a width of 60 mm in the paper feed direction, with a gap of 1 mm, from the leading end, and a width of 200 mm in a direction perpendicular to the paper feed direction. The toner laid-on level in the unfixed image was 1.2 mg/cm$^2$. The fixing temperature was sequentially raised from 100° C. in increments of 5° C., and there was measured the temperature at which the fixed image wrapped around the fixing roller. A wrapping temperature of 150° C. or lower corresponds to an unacceptable level in the present invention. The results of the fixability evaluation are given in Table 5.

Examples 2 to 30

Comparative Examples 1 to 5

The toner used in the two-component developer in Example 1 was modified according to Table 3. Otherwise, toners were evaluated in the same way as in Example 1. The evaluation results are given in Table 4-1 (23° C., 50% RH), Table 4-2 (23° C., 5% RH), Table 4-3(32.5° C., 80% RH) and Table 5.

TABLE 3

| | Toner No. | Carrier No. | Two-component developer No. |
|---|---|---|---|
| Example 1 | Toner 1 | Carrier 1 | Two-component developer 1 |
| Example 2 | Toner 2 | Carrier 1 | Two-component developer 2 |
| Example 3 | Toner 3 | Carrier 1 | Two-component developer 3 |
| Example 4 | Toner 4 | Carrier 1 | Two-component developer 4 |
| Example 5 | Toner 5 | Carrier 1 | Two-component developer 5 |
| Example 6 | Toner 6 | Carrier 1 | Two-component developer 6 |
| Example 7 | Toner 7 | Carrier 1 | Two-component developer 7 |
| Example 8 | Toner 8 | Carrier 1 | Two-component developer 8 |
| Example 9 | Toner 9 | Carrier 1 | Two-component developer 9 |
| Example 10 | Toner 10 | Carrier 1 | Two-component developer 10 |
| Example 11 | Toner 11 | Carrier 1 | Two-component developer 11 |
| Example 12 | Toner 12 | Carrier 1 | Two-component developer 12 |
| Example 13 | Toner 13 | Carrier 1 | Two-component developer 13 |
| Example 14 | Toner 14 | Carrier 1 | Two-component developer 14 |
| Example 15 | Toner 15 | Carrier 1 | Two-component developer 15 |
| Example 16 | Toner 16 | Carrier 1 | Two-component developer 16 |
| Example 17 | Toner 17 | Carrier 1 | Two-component developer 17 |
| Example 18 | Toner 18 | Carrier 1 | Two-component developer 18 |
| Example 19 | Toner 19 | Carrier 1 | Two-component developer 19 |
| Example 20 | Toner 20 | Carrier 1 | Two-component developer 20 |
| Example 21 | Toner 21 | Carrier 1 | Two-component developer 21 |
| Example 22 | Toner 22 | Carrier 1 | Two-component developer 22 |
| Example 23 | Toner 23 | Carrier 1 | Two-component developer 23 |
| Example 24 | Toner 24 | Carrier 1 | Two-component developer 24 |
| Example 25 | Toner 25 | Carrier 1 | Two-component developer 25 |
| Example 26 | Toner 26 | Carrier 1 | Two-component developer 26 |
| Example 27 | Toner 27 | Carrier 1 | Two-component developer 27 |
| Comparative Example 1 | Toner 28 | Carrier 1 | Two-component developer 28 |
| Comparative Example 2 | Toner 29 | Carrier 1 | Two-component developer 29 |
| Comparative Example 3 | Toner 30 | Carrier 1 | Two-component developer 30 |
| Comparative Example 4 | Toner 31 | Carrier 1 | Two-component developer 31 |
| Comparative Example 5 | Toner 32 | Carrier 1 | Two-component developer 32 |
| Example 28 | Toner 33 | Carrier 1 | Two-component developer 33 |
| Example 29 | Toner 34 | Carrier 1 | Two-component developer 34 |
| Example 30 | Toner 35 | Carrier 1 | Two-component developer 35 |

TABLE 4-1

Evaluation of development properties (23° C., 50% RH)

| | Density | | Density | Eval- | Fogging | |
|---|---|---|---|---|---|---|
| | 1$^{st}$ print | 1000-th print | difference Δ | uation rank | 1$^{st}$ print | 1000-th print |
| Example 1 | 1.50 | 1.49 | 0.01 | A | A(0.1) | A(0.2) |
| Example 2 | 1.50 | 1.46 | 0.04 | A | A(0.1) | A(0.3) |
| Example 3 | 1.50 | 1.45 | 0.05 | B | A(0.2) | A(0.4) |
| Example 4 | 1.50 | 1.45 | 0.05 | B | A(0.3) | A(0.4) |
| Example 5 | 1.50 | 1.44 | 0.06 | B | A(0.3) | A(0.4) |
| Example 6 | 1.50 | 1.46 | 0.04 | A | A(0.3) | A(0.3) |
| Example 7 | 1.50 | 1.46 | 0.04 | A | A(0.3) | B(0.8) |
| Example 8 | 1.50 | 1.40 | 0.10 | C | A(0.3) | C(1.0) |
| Example 9 | 1.50 | 1.38 | 0.12 | C | B(0.5) | C(1.3) |
| Example 10 | 1.50 | 1.33 | 0.17 | C | B(0.6) | C(1.2) |
| Example 11 | 1.50 | 1.44 | 0.06 | B | B(0.6) | C(1.3) |
| Example 12 | 1.50 | 1.42 | 0.08 | B | B(0.7) | C(1.2) |
| Example 13 | 1.50 | 1.45 | 0.05 | B | B(0.6) | C(1.2) |
| Example 14 | 1.50 | 1.43 | 0.07 | B | B(0.7) | C(1.2) |
| Example 15 | 1.50 | 1.41 | 0.09 | B | B(0.7) | C(1.2) |
| Example 16 | 1.50 | 1.42 | 0.08 | B | B(0.8) | C(1.2) |
| Example 17 | 1.50 | 1.39 | 0.11 | C | B(0.8) | C(1.2) |
| Example 18 | 1.50 | 1.35 | 0.15 | C | C(1.2) | C(1.5) |
| Example 19 | 1.50 | 1.42 | 0.08 | B | C(1.0) | C(1.2) |
| Example 20 | 1.50 | 1.42 | 0.08 | B | B(0.7) | C(1.2) |

TABLE 4-1-continued

| Evaluation of development properties (23° C., 50% RH) | | | | | | |
|---|---|---|---|---|---|---|
| | Density | | Density | Eval- | Fogging | |
| | 1st print | 1000-th print | difference Δ | uation rank | 1st print | 1000-th print |
| Example 21 | 1.50 | 1.44 | 0.06 | B | B(0.7) | B(0.9) |
| Example 22 | 1.50 | 1.40 | 0.10 | C | B(0.7) | C(1.2) |
| Example 23 | 1.50 | 1.40 | 0.10 | C | B(0.7) | C(1.2) |
| Example 24 | 1.50 | 1.32 | 0.18 | C | C(1.2) | C(1.5) |
| Example 25 | 1.50 | 1.42 | 0.08 | B | B(0.6) | B(0.8) |
| Example 26 | 1.50 | 1.35 | 0.15 | C | C(1.2) | C(1.5) |
| Example 27 | 1.50 | 1.35 | 0.15 | C | C(1.2) | C(1.5) |
| Comparative Example 1 | 1.50 | 1.31 | 0.19 | C | A(0.4) | C(1.8) |
| Comparative Example 2 | 1.50 | 1.29 | 0.21 | D | C(1.3) | C(1.6) |
| Comparative Example 3 | 1.50 | 1.25 | 0.25 | D | D(2.2) | D(2.8) |
| Comparative Example 4 | 1.50 | 1.15 | 0.35 | D | B(0.5) | C(1.8) |
| Comparative Example 5 | 1.50 | 1.20 | 0.30 | D | A(0.4) | C(1.6) |
| Example 28 | 1.50 | 1.39 | 0.11 | C | A(0.3) | C(1.2) |
| Example 29 | 1.50 | 1.37 | 0.13 | C | A(0.4) | C(1.5) |
| Example 30 | 1.50 | 1.35 | 0.15 | C | B(0.5) | C(1.8) |

TABLE 4-2

| Evaluation of development properties (23° C., 5% RH) | | | | | | |
|---|---|---|---|---|---|---|
| | Density | | Density | Eval- | Fogging | |
| | 1st print | 1000-th print | difference Δ | uation rank | 1st print | 1000-th print |
| Example 1 | 1.50 | 1.45 | 0.05 | B | A(0.3) | A(0.4) |
| Example 2 | 1.50 | 1.45 | 0.05 | B | A(0.4) | A(0.3) |
| Example 3 | 1.50 | 1.43 | 0.07 | B | A(0.4) | B(0.5) |
| Example 4 | 1.50 | 1.45 | 0.05 | B | A(0.4) | B(0.5) |
| Example 5 | 1.50 | 1.43 | 0.07 | B | A(0.4) | B(0.6) |
| Example 6 | 1.50 | 1.42 | 0.08 | B | B(0.5) | B(0.5) |
| Example 7 | 1.50 | 1.42 | 0.08 | B | B(0.6) | C(1.3) |
| Example 8 | 1.50 | 1.35 | 0.15 | C | B(0.5) | C(1.5) |
| Example 9 | 1.50 | 1.32 | 0.18 | C | B(0.6) | C(1.5) |
| Example 10 | 1.50 | 1.31 | 0.19 | C | C(1.2) | C(1.6) |
| Example 11 | 1.50 | 1.41 | 0.09 | B | B(0.8) | C(1.4) |
| Example 12 | 1.50 | 1.39 | 0.11 | C | C(1.0) | C(1.5) |
| Example 13 | 1.50 | 1.41 | 0.09 | B | B(0.7) | C(1.6) |
| Example 14 | 1.50 | 1.38 | 0.12 | C | B(0.9) | C(1.6) |
| Example 15 | 1.50 | 1.38 | 0.12 | C | C(1.0) | C(1.6) |
| Example 16 | 1.50 | 1.37 | 0.13 | C | C(1.2) | C(1.6) |
| Example 17 | 1.50 | 1.35 | 0.15 | C | C(1.1) | C(1.6) |
| Example 18 | 1.50 | 1.31 | 0.19 | C | C(1.6) | C(1.8) |
| Example 19 | 1.50 | 1.38 | 0.12 | C | C(1.5) | C(1.8) |
| Example 20 | 1.50 | 1.38 | 0.12 | C | C(1.2) | C(1.8) |
| Example 21 | 1.50 | 1.40 | 0.10 | C | C(1.2) | C(1.2) |
| Example 22 | 1.50 | 1.35 | 0.15 | C | C(1.3) | C(1.6) |
| Example 23 | 1.50 | 1.35 | 0.15 | C | C(1.3) | C(1.7) |
| Example 24 | 1.50 | 1.31 | 0.19 | C | C(1.8) | C(1.8) |
| Example 25 | 1.50 | 1.38 | 0.12 | C | C(1.4) | C(1.2) |
| Example 26 | 1.50 | 1.32 | 0.18 | C | C(1.8) | C(1.9) |
| Example 27 | 1.50 | 1.31 | 0.19 | C | C(1.6) | C(1.9) |
| Comparative Example 1 | 1.50 | 1.28 | 0.22 | D | B(0.8) | D(2.3) |
| Comparative Example 2 | 1.50 | 1.25 | 0.25 | D | C(1.8) | D(2.2) |
| Comparative Example 3 | 1.50 | 1.19 | 0.31 | D | D(3.1) | D(3.2) |
| Comparative Example 4 | 1.50 | 1.05 | 0.45 | D | C(1.2) | D(2.3) |
| Comparative Example 5 | 1.50 | 1.23 | 0.27 | D | B(0.6) | D(2.1) |

TABLE 4-2-continued

| Evaluation of development properties (23° C., 5% RH) | | | | | | |
|---|---|---|---|---|---|---|
| | Density | | Density | Eval- | Fogging | |
| | 1st print | 1000-th print | difference Δ | uation rank | 1st print | 1000-th print |
| Example 28 | 1.50 | 1.33 | 0.17 | C | B(0.6) | C(1.5) |
| Example 29 | 1.50 | 1.32 | 0.18 | C | B(0.8) | C(1.8) |
| Example 30 | 1.50 | 1.31 | 0.19 | C | B(0.9) | C(1.9) |

TABLE 4-3

| Evaluation of development properties (32.5° C., 80% RH) | | | | | | |
|---|---|---|---|---|---|---|
| | Density | | Density | Eval- | Fogging | |
| | 1st print | 1000-th print | difference Δ | uation rank | 1st print | 1000-th print |
| Example 1 | 1.50 | 1.48 | 0.02 | A | A(0.2) | A(0.2) |
| Example 2 | 1.50 | 1.46 | 0.04 | A | A(0.2) | A(0.3) |
| Example 3 | 1.50 | 1.45 | 0.05 | B | A(0.3) | B(0.5) |
| Example 4 | 1.50 | 1.44 | 0.06 | B | A(0.3) | B(0.6) |
| Example 5 | 1.50 | 1.43 | 0.07 | B | A(0.4) | B(0.6) |
| Example 6 | 1.50 | 1.45 | 0.05 | B | A(0.4) | B(0.5) |
| Example 7 | 1.50 | 1.45 | 0.05 | B | A(0.4) | C(1.0) |
| Example 8 | 1.50 | 1.38 | 0.12 | C | A(0.4) | C(1.2) |
| Example 9 | 1.50 | 1.35 | 0.15 | C | B(0.6) | C(1.4) |
| Example 10 | 1.50 | 1.32 | 0.18 | C | B(0.8) | C(1.5) |
| Example 11 | 1.50 | 1.43 | 0.07 | B | B(0.6) | C(1.2) |
| Example 12 | 1.50 | 1.41 | 0.09 | B | B(0.8) | C(1.3) |
| Example 13 | 1.50 | 1.43 | 0.07 | B | B(0.6) | C(1.4) |
| Example 14 | 1.50 | 1.41 | 0.09 | B | B(0.8) | C(1.3) |
| Example 15 | 1.50 | 1.39 | 0.11 | C | B(0.7) | C(1.2) |
| Example 16 | 1.50 | 1.38 | 0.12 | C | B(0.8) | C(1.3) |
| Example 17 | 1.50 | 1.37 | 0.13 | C | B(0.9) | C(1.4) |
| Example 18 | 1.50 | 1.32 | 0.18 | C | C(1.4) | C(1.8) |
| Example 19 | 1.50 | 1.40 | 0.10 | C | C(1.2) | C(1.4) |
| Example 20 | 1.50 | 1.41 | 0.09 | B | B(0.8) | C(1.4) |
| Example 21 | 1.50 | 1.43 | 0.07 | B | B(0.8) | B(0.9) |
| Example 22 | 1.50 | 1.39 | 0.11 | C | B(0.9) | C(1.4) |
| Example 23 | 1.50 | 1.38 | 0.12 | C | B(0.9) | C(1.4) |
| Example 24 | 1.50 | 1.31 | 0.19 | C | C(1.5) | C(1.9) |
| Example 25 | 1.50 | 1.39 | 0.11 | C | B(0.8) | B(0.9) |
| Example 26 | 1.50 | 1.31 | 0.19 | C | C(1.5) | C(1.8) |
| Example 27 | 1.50 | 1.31 | 0.19 | C | C(1.5) | C(1.9) |
| Comparative Example 1 | 1.50 | 1.29 | 0.21 | D | B(0.6) | D(2.1) |
| Comparative Example 2 | 1.50 | 1.25 | 0.25 | D | C(1.6) | C(1.9) |
| Comparative Example 3 | 1.50 | 1.22 | 0.28 | D | D(2.5) | D(3.2) |
| Comparative Example 4 | 1.50 | 1.10 | 0.40 | D | B(0.7) | D(2.1) |
| Comparative Example 5 | 1.50 | 1.15 | 0.35 | D | B(0.5) | C(1.4) |
| Example 28 | 1.50 | 1.38 | 0.12 | C | A(0.3) | C(1.3) |
| Example 29 | 1.50 | 1.36 | 0.14 | C | B(0.5) | C(1.6) |
| Example 30 | 1.50 | 1.34 | 0.16 | C | B(0.6) | C(1.8) |

TABLE 5

| Fixability evaluation (low-temperature fixability, hot-offset resistance, gloss and fixing wrapping resistance) | | | | |
|---|---|---|---|---|
| | Low-temperature fixability | Hot-offset resistance | Gloss | Fixing wrapping resistance |
| Example 1 | 145° C. | 185° C. | 16.8 | 210° C. |
| Example 2 | 145° C. | 185° C. | 16.8 | 210° C. |
| Example 3 | 145° C. | 185° C. | 16.8 | 210° C. |
| Example 4 | 145° C. | 185° C. | 16.8 | 210° C. |
| Example 5 | 145° C. | 185° C. | 16.8 | 210° C. |

TABLE 5-continued

| Fixability evaluation (low-temperature fixability, hot-offset resistance, gloss and fixing wrapping resistance) | | | | |
|---|---|---|---|---|
| | Low-temperature fixability | Hot-offset resistance | Gloss | Fixing wrapping resistance |
| Example 6 | 155° C. | 170° C. | 12.3 | 165° C. |
| Example 7 | 145° C. | 185° C. | 15.2 | 210° C. |
| Example 8 | 145° C. | 190° C. | 18.6 | 210° C. |
| Example 9 | 145° C. | 190° C. | 18.7 | 210° C. |
| Example 10 | 145° C. | 190° C. | 18.5 | 210° C. |
| Example 11 | 145° C. | 185° C. | 15.2 | 210° C. |
| Example 12 | 165° C. | 180° C. | 10.5 | 165° C. |
| Example 13 | 150° C. | 180° C. | 11.0 | 200° C. |
| Example 14 | 160° C. | 180° C. | 9.8 | 180° C. |
| Example 15 | 145° C. | 185° C. | 15.2 | 200° C. |
| Example 16 | 145° C. | 185° C. | 14.0 | 165° C. |
| Example 17 | 145° C. | 185° C. | 13.2 | 165° C. |
| Example 18 | 145° C. | 170° C. | 18.2 | 190° C. |
| Example 19 | 145° C. | 170° C. | 17.8 | 190° C. |
| Example 20 | 145° C. | 185° C. | 15.0 | 210° C. |
| Example 21 | 150° C. | 180° C. | 12.3 | 165° C. |
| Example 22 | 145° C. | 175° C. | 12.0 | 165° C. |
| Example 23 | 145° C. | 165° C. | 12.0 | 165° C. |
| Example 24 | 145° C. | 165° C. | 18.0 | 185° C. |
| Example 25 | 155° C. | 165° C. | 11.2 | 165° C. |
| Example 26 | 145° C. | 185° C. | 20.1 | 210° C. |
| Example 27 | 145° C. | 185° C. | 19.8 | 210° C. |
| Comparative Example 1 | 145° C. | 165° C. | 15.2 | 150° C. |
| Comparative Example 2 | 145° C. | 185° C. | 17.2 | 210° C. |
| Comparative Example 3 | 145° C. | 180° C. | 18.6 | 200° C. |
| Comparative Example 4 | 150° C. | 165° C. | 10.2 | 145° C. |
| Comparative Example 5 | 145° C. | 185° C. | 16.8 | 210° C. |
| Example 28 | 145° C. | 190° C. | 18.7 | 210° C. |
| Example 29 | 145° C. | 190° C. | 18.6 | 210° C. |
| Example 30 | 145° C. | 190° C. | 18.9 | 210° C. |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-265602, filed Nov. 29, 2010, which is hereby incorporated by reference herein in its entirety.

REFERENCE SIGNS LIST

100: toner particles feeding port, 101: hot air feeding port, 102: airflow jetting member, 103: cold air feeding port, 104: second cold air feeding port, 106: cooling jacket, 114: starting material toner, 115: high-pressure air supply nozzle, 116: transport pipe.

The invention claimed is:

1. A toner comprising toner particles, each of which contains a binder resin, a wax, a colorant and inorganic fine particles, wherein the binder resin is a polyester resin, the wax is a hydrocarbon wax, the inorganic fine particles are fixed at the surface of the toner particles as a result of a surface treatment by hot air, and the toner satisfies the following formula (1):

$$1.20 \leq P1/P2 \leq 2.00 \quad (1)$$

in the formula (1), P1=Pa/Pb and P2=Pc/Pd, wherein,

Pa is an intensity of the highest absorption peak in a range from 2843 $cm^{-1}$ to 2853 $cm^{-1}$, and Pb is an intensity of the highest absorption peak in a range from 1713 $cm^{-1}$ to 1723 $cm^{-1}$ in an FT-IR spectrum obtained by an attenuated total reflectance (ATR) method by using Ge as the ATR crystal and under the condition of an infrared light-incidence angle of 45°, and wherein Pc is an intensity of the highest absorption peak in a range from 2843 $cm^{-1}$ to 2853 $cm^{-1}$, and Pd is an intensity of the highest absorption peak in a range from 1713 $cm^{-1}$ to 1723 $cm^{-1}$ in an FT-IR spectrum obtained by an attenuated total reflectance (ATR) method by using KRS5 as the ATR crystal and under the condition of an infrared light-incidence angle of 45°.

2. The toner according to claim 1, wherein the wax exhibits a peak temperature of the highest endothermic peak of from 50° C. to 110° C., in an endothermic curve upon rise of temperature as measured by a differential scanning calorimeter (DSC) in a temperature range from 30° C. to 200° C.

3. The toner according to claim 1, wherein the proportion of particles in the toner having a circle-equivalent diameter ranging from 0.50 μm to less than 1.98 μm with respect to the total of particles having a circle-equivalent diameter ranging from 0.50 μm to less than 39.69 μm is no greater than 15.0 number %, as measured by a flow-type particle image measuring device at an image processing resolution of 512×512 pixels (0.37 μm×0.37 μm per pixel).

4. The toner according to claim 1, wherein a specific surface area of the inorganic fine particles ranges from 10 $m^2/g$ to 60 $m^2/g$.

5. The toner according to claim 1, wherein the P1/P2 ranges from 1.30 to 1.80.

* * * * *